US010792209B2

(12) United States Patent
Son et al.

(10) Patent No.: US 10,792,209 B2
(45) Date of Patent: Oct. 6, 2020

(54) WEARABLE ASSISTIVE DEVICE THAT EFFICIENTLY DELIVERS ASSISTIVE FORCE

(71) Applicant: LG ELECTRONICS INC., Seoul (KR)

(72) Inventors: Jung Kyu Son, Seoul (KR); Bohyun Nam, Seoul (KR); Kyu Tae Park, Seoul (KR); Seonil Yu, Seoul (KR); Wonjun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/282,458

(22) Filed: Feb. 22, 2019

(65) Prior Publication Data

US 2019/0262211 A1 Aug. 29, 2019

Related U.S. Application Data

(60) Provisional application No. 62/730,399, filed on Sep. 12, 2018, provisional application No. 62/730,400, (Continued)

(30) Foreign Application Priority Data

Feb. 23, 2018 (KR) ..... 10-2018-0021950
Feb. 23, 2018 (KR) ..... 10-2018-0021951
(Continued)

(51) Int. Cl.
*A61H 1/02* (2006.01)
*A63B 21/00* (2006.01)
(Continued)

(52) U.S. Cl.
CPC ..... *A61H 1/0262* (2013.01); *A61H 1/024* (2013.01); *A61H 1/0237* (2013.01);
(Continued)

(58) Field of Classification Search
CPC combination set(s) only.
See application file for complete search history.

(56) References Cited

U.S. PATENT DOCUMENTS 406,328 A 7/1889 Yagn
4,058,119 A 11/1977 Rosequist
(Continued)

FOREIGN PATENT DOCUMENTS

CN 103610524 3/2014
CN 103610568 3/2014
(Continued)

OTHER PUBLICATIONS

International Search Report dated May 9, 2019 issued in Application No. PCT/KR2019/001079.
(Continued)

*Primary Examiner* — Yashita Sharma
(74) *Attorney, Agent, or Firm* — Ked & Associates LLP

(57) ABSTRACT

A wearable assistive device such as an exoskeleton may include a main frame that support a hip joint of a user. The main frame may have a predetermined curvature and structure that closely conforms to and remains in contact with a hip of the user at or near the hip joint so that the main frame may stably support both hip joints. While the user wears the exoskeleton and walks, bends, or lifts, the exoskeleton may stably and efficiently provide a force to assist a movement originating at the hip joint of the user, thereby aiding the user in stably walking, bending, or lifting.

3 Claims, 29 Drawing Sheets

Related U.S. Application Data filed on Sep. 12, 2018, provisional application No. 62/730,412, filed on Sep. 12, 2018, provisional application No. 62/730,420, filed on Sep. 12, 2018.

(30) Foreign Application Priority Data

Mar. 16, 2018 (KR) ..... 10-2018-0030949
Jul. 4, 2018 (KR) ..... 10-2018-0077830

(51) Int. Cl.
*A61H 3/00* (2006.01)
*A63B 23/04* (2006.01)

(52) U.S. Cl.
CPC ..... *A61H 1/0244* (2013.01); *A61H 3/00* (2013.01); *A63B 21/0004* (2013.01); *A63B 21/00181* (2013.01); *A63B 21/4009* (2015.10); *A63B 21/4011* (2015.10); *A63B 23/0405* (2013.01); *A61H 2003/007* (2013.01); *A61H 2201/0107* (2013.01); *A61H 2201/0192* (2013.01); *A61H 2201/1207* (2013.01); *A61H 2201/1215* (2013.01); *A61H 2201/1238* (2013.01); *A61H 2201/163* (2013.01); *A61H 2201/164* (2013.01); *A61H 2201/165* (2013.01); *A61H 2201/1621* (2013.01); *A61H 2201/1642* (2013.01); *A63B 2225/09* (2013.01)

(56) References Cited

U.S. PATENT DOCUMENTS

| | | | |
|---|---|---|---|
| 4,669,451 | A | 6/1987 | Blauth |
| 6,171,272 | B1 | 1/2001 | Akita et al. |
| 6,607,202 | B1 | 8/2003 | Palmer |
| 6,694,643 | B1 | 2/2004 | Hsu |
| 7,628,766 | B1 | 12/2009 | Kazerooni et al. |
| 7,744,552 | B1 | 6/2010 | Babcock |
| 9,314,393 | B2 | 4/2016 | Kim et al. |
| 9,849,048 | B2 | 12/2017 | Borisoff et al. |
| 9,956,107 | B2 | 5/2018 | Blanck |
| 2005/0059908 | A1 | 3/2005 | Bogert |
| 2005/0070834 | A1 | 3/2005 | Herr et al. |
| 2006/0020237 | A1 | 1/2006 | Nordt, III et al. |
| 2006/0064047 | A1 | 3/2006 | Shimada et al. |
| 2006/0258967 | A1 | 11/2006 | Fujil et al. |
| 2006/0276728 | A1 | 12/2006 | Ashihara et al. |
| 2007/0106190 | A1 | 5/2007 | Katoh et al. |
| 2009/0259155 | A1 | 10/2009 | Shimada |
| 2010/0121232 | A1 | 5/2010 | Sankai |
| 2010/0126542 | A1 | 5/2010 | Pennise |
| 2010/0170546 | A1 | 7/2010 | Popovic |
| 2010/0271051 | A1 | 10/2010 | Sankai |
| 2010/0280629 | A1 | 11/2010 | Jung et al. |
| 2010/0331150 | A1 | 12/2010 | Patoglu |
| 2011/0071442 | A1 | 3/2011 | Park et al. |
| 2011/0172570 | A1 | 7/2011 | Shimizu et al. |
| 2012/0259429 | A1 | 10/2012 | Han et al. |
| 2012/0271207 | A1 | 10/2012 | Schoen et al. |
| 2013/0046218 | A1 | 2/2013 | Wiggin et al. |
| 2013/0079686 | A1 | 3/2013 | Sessions |
| 2013/0226048 | A1 | 8/2013 | Unluhisarcikli et al. |
| 2014/0171838 | A1 | 6/2014 | Aleksov et al. |
| 2014/0200499 | A1 | 7/2014 | Champion |
| 2014/0330431 | A1 | 11/2014 | Hollander et al. |
| 2015/0038889 | A1 | 2/2015 | Mason et al. |
| 2015/0051638 | A1 | 2/2015 | Dickinson et al. |
| 2015/0134080 | A1 | 5/2015 | Roh |
| 2015/0173929 | A1 | 6/2015 | Kazerooni et al. |
| 2015/0182366 | A1 | 7/2015 | Takenaka et al. |
| 2015/0209215 | A1 | 7/2015 | Lee et al. |
| 2015/0272810 | A1 | 10/2015 | Teng et al. |
| 2015/0272811 | A1 | 10/2015 | Choi |
| 2015/0283009 | A1 | 10/2015 | Borisoff et al. |
| 2015/0313786 | A1 | 11/2015 | Sano |
| 2015/0335515 | A1 | 11/2015 | Lee et al. |
| 2016/0045382 | A1 | 2/2016 | Goffer |
| 2016/0250093 | A1 | 9/2016 | Koren |
| 2016/0317340 | A1 | 11/2016 | Jangir |
| 2016/0331624 | A1 | 11/2016 | Sankai et al. |
| 2017/0020692 | A1 | 1/2017 | Lee |
| 2017/0049659 | A1 | 2/2017 | Farris et al. |
| 2017/0065441 | A1 | 3/2017 | Lee et al. |
| 2017/0071814 | A1 | 3/2017 | Endo |
| 2017/0165087 | A1 | 6/2017 | Kim et al. |
| 2017/0360645 | A1 | 12/2017 | Sodeyama |
| 2018/0056104 | A1 | 3/2018 | Cromie et al. |
| 2018/0200134 | A1 | 7/2018 | Tsai et al. |
| 2018/0257216 | A1 | 9/2018 | Shavit |
| 2018/0272524 | A1 | 9/2018 | Ohtsubo |
| 2018/0272525 | A1 | 9/2018 | Kumeno |
| 2018/0296424 | A1 | 10/2018 | Parra et al. |
| 2018/0325764 | A1 | 11/2018 | Yagi |
| 2019/0015273 | A1 | 1/2019 | Linon |
| 2019/0091094 | A1 | 3/2019 | Romo |
| 2019/0254854 | A1 | 8/2019 | Lee et al. |
| 2019/0254909 | A1 | 8/2019 | Lee et al. |
| 2019/0254914 | A1 | 8/2019 | Nam |
| 2019/0262211 | A1 | 8/2019 | Son |
| 2019/0283235 | A1 | 9/2019 | Nam |
| 2019/0283236 | A1 | 9/2019 | Nam |
| 2019/0314238 | A1 | 10/2019 | Kobayashi |
| 2019/0344429 | A1 | 11/2019 | Grenier |
| 2019/0344430 | A1 | 11/2019 | Baptista |
| 2019/0344431 | A1 | 11/2019 | Grenier |
| 2019/0344432 | A1 | 11/2019 | Grenier |
| 2020/0038219 | A1 | 2/2020 | Mizera |
| 2020/0078254 | A1 | 3/2020 | Uematsu |
| 2020/0085667 | A1 | 3/2020 | Chen |

FOREIGN PATENT DOCUMENTS

| | | |
|---|---|---|
| CN | 105662780 | 6/2016 |
| CN | 106420270 | 2/2017 |
| CN | 107595555 | 1/2018 |
| CN | 108624199 | 9/2018 |
| EP | 3 103 426 | 12/2016 |
| EP | 3 181 110 | 6/2017 |
| EP | 3 207 909 | 8/2017 |
| JP | H 07-116207 | 5/1995 |
| JP | 2005-000634 | 1/2005 |
| JP | 2006-087533 | 4/2006 |
| JP | 2007-089633 | 4/2007 |
| JP | 2011-045657 | 3/2011 |
| JP | 2011-139869 | 7/2011 |
| JP | 2013-070784 | 4/2013 |
| JP | 2015-136623 | 7/2015 |
| JP | 2015-139665 | 8/2015 |
| JP | 2015-188740 | 11/2015 |
| JP | 2015-221139 | 12/2015 |
| JP | 5878583 | 3/2016 |
| JP | 2016-209443 | 12/2016 |
| KR | 20-1999-0027436 | 7/1999 |
| KR | 10-0716597 | 5/2007 |
| KR | 10-1052692 | 7/2011 |
| KR | 10-1070973 | 10/2011 |
| KR | 10-2011-0124924 | 11/2011 |
| KR | 10-1146112 | 5/2012 |
| KR | 10-2012-0104742 | 9/2012 |
| KR | 10-1196104 | 11/2012 |
| KR | 10-1219795 | 1/2013 |
| KR | 10-2013-0045777 | 5/2013 |
| KR | 20-0470552 | 12/2013 |
| KR | 10-1363834 | 2/2014 |
| KR | 10-1363850 | 2/2014 |
| KR | 10-1417895 | 7/2014 |
| KR | 10-1433284 | 9/2014 |
| KR | 10-2014-0121371 | 10/2014 |
| KR | 10-1536586 | 7/2015 |
| KR | 10-1600600 | 3/2016 |
| KR | 10-2016-0091025 | 8/2016 |
| KR | 10-1650101 | 8/2016 |
| KR | 10-1735214 | 5/2017 |

(56) References Cited

FOREIGN PATENT DOCUMENTS

| | | |
|---|---|---|
| KR | 10-1737885 | 5/2017 |
| KR | 10-2017-0111279 | 10/2017 |
| KR | 10-1787555 | 10/2017 |
| KR | 10-4787557 | 10/2017 |
| KR | 10-1788567 | 11/2017 |
| WO | WO 2012/125765 | 9/2012 |

OTHER PUBLICATIONS

International Search Report dated May 16, 2019 issued in Application No. PCT/KR2019/001086.
International Search Report dated May 16, 2019 issued in Application No. PCT/KR2019/001088.
European Search Report dated May 27, 2019 issued in Application No. 19158443.2.
European Search Report dated Jun. 11, 2019 issued in Application No. 19159508.1.
European Search Report dated Jun. 11, 2019 issued in Application No. 19159516.4.
International Search Report dated Jun. 11, 2019 issued in Application No. PCT/KR2019/002175.
International Search Report dated Jun. 12, 2019 issued in Application No. PCT/KR2019/002239.
European Search Report dated Aug. 13, 2019 issued in Application No. 19158779.9.
European Search Report dated Aug. 13, 2019 issued in Application No. 19158657.7.
U.S. Appl. No. 16/274,560, filed Feb. 13, 2019.
U.S. Appl. No. 16/274,584, filed Feb. 13, 2019.
U.S. Appl. No. 16/274,613, filed Feb. 13, 2019.
U.S. Appl. No. 16/274,662, filed Feb. 13, 2019.
U.S. Appl. No. 16/274,697, filed Feb. 13, 2019.
U.S. Appl. No. 16/282,409, filed Feb. 22, 2019.
U.S. Appl. No. 16/352,920, filed Mar. 14, 2019.
U.S. Appl. No. 16/352,940, filed Mar. 14, 2019.
U.S. Appl. No. 16/274,798, filed Feb. 13, 2019.
U.S. Appl. No. 16/353,843, filed Mar. 14, 2019.
U.S. Appl. No. 16/583,744, filed Sep. 26, 2019.
International Search Report dated Jul. 4, 2019 issued in Application No. PCT/KR2019/003071.
International Search Report dated Jul. 12, 2019 issued in Application No. PCT/KR2019/003070.
European Search Report dated Aug. 13, 2019 issued in Application No. 19163259.5.
European Search Report dated Aug. 13, 2019 issued in Application No. 19163268.6.
European Search Report dated Aug. 27, 2019 issued in Application No. 19158443.2.
Article from https://social .lge.co.kr/newsroom/lg_cloisuitbot_1227/, dated Dec. 27, 2018, entitled, "ArtCLOi Suitbot Unveiled Wearable Robot That Increases Waist Strength.".
International Search Report dated Sep. 26, 2019 issued in Application No. PCT/KR2019/000059.
U.S. Office Action dated Jul. 13, 2020 issued in U.S. Appl. No. 16/274,697.
U.S. Office Action dated Aug. 24, 2020 issued in co-pending related U.S. Appl. No. 16/274,560.
U.S. Office Action dated Aug. 25, 2020 issued in co-pending related U.S. Appl. No. 16/274,584.

WEARABLE ASSISTIVE DEVICE THAT EFFICIENTLY DELIVERS ASSISTIVE FORCE

CROSS-REFERENCE TO RELATED APPLICATIONS

This application claims priority under 35 U.S.C. § 119 to U.S. Provisional Patent Application Nos. 62/730,399, 62/730,400, 62/730,412, and 62/730,420, all filed on Sep. 12, 2018, and also to Korean Patent Application No. 10-2018-0021950 filed on Feb. 23, 2018, and Korean Patent Application No. 10-2018-0021951, filed on Feb. 23, 2018, and Korean Patent Application No. 10-2018-0030949, filed on Mar. 16, 2018, and Korean Patent Application No. 10-2018-0077830, filed on Jul. 4, 2018, whose entire disclosures are hereby incorporated by reference.

BACKGROUND

1. Field

This application relates to assistive and/or rehabilitative technology.

2. Background

In assistive and/or rehabilitative technology, wearable assistive been used to assist and/or augment a movement or strength of a user. The wearable assistive device may be a kind of wearable robot, and more specifically an exoskeleton, having a multi-joint skeletal structure. The wearable assistive device may assist the user in walking by providing an assistive force generated from a driving means such as an actuator or motor to the user. The assistive force may be provided to aid a movement of the user's joints. These wearable assistive devices may be worn on a waist, a leg, and a foot of the user, or may be worn on an upper body or an entire body.

Korean Patent No. 10-1219795 and US Patent Application No. 2015-0134080 provide a conventional power assisting apparatus that assists a walking of a user. A conventional power assisting apparatus will be described with reference to the above.

FIG. 1 is a view showing a state in which a user wears the power assisting apparatus (KR 10-1219795). Referring to FIG. 1, the power assisting apparatus may have a waist or pelvic portion 11 worn on the waist of the user. A pair of leg supports may be installed on both or opposite sides of the waist portion 11 to support an outside of a leg of the user. Each leg support may have a thigh support 12 to support a thigh of the user and a shin support 14 to support a shin of the user.

A hip drive 13 may be installed between the waist portion 11 and the thigh support 12. The hip drive 13 may deliver a first assistive force to a hip joint of a user. A knee drive 15 may be installed between the thigh support 12 and the shin support 14. The knee drive 15 may deliver a second assistive force to a knee joint of a user.

An inner surface of the hip drive 13 may be formed in a plate shape. Therefore, the hip drive 13 may not be in close or complete contact with a hip or pelvis of a user, and may limit a movement of the user. The drive 13 may not be able to accommodate various shapes of users or hips. A part of the first assistive force generated from the hip drive 13 may therefore be lost while it is delivered to the hip joint of the user due to the spacing.

Further, an axis line of the hip drive 13, which may be installed on both sides of the waist portion 11 while the user walks, may frequently deviate from a hip joint axis of the user. The first assistive force generated from the hip drive 13 may be incorrectly delivered or misapplied to the hip joint of the user. The hip drive 13 may not independently secure to two sides of the user. While the user walks, each hip drive 13 may be deviated from the hip joint of the user, rendering walking unnatural.

FIG. 2 is a view showing a conventional wearable assistive device or conventional wearable robot (US 2015-0134080). Referring to FIG. 2, the wearable robot may have a waist portion 11' and a hip drive 13' installed on two sides of the waist portion 11'.

The hip drive 13' may only allow a leg of a user to rotate in forward and rearward directions. Accordingly, the hip drive 13' may deliver a first assistive force to a hip joint of a user only when the user rotates or moves the legs along the forward and rearward directions. The hip drive 13' may not deliver the first assistive force when the user rotates the legs in inward and outward, e.g., leftward and rightward, directions. The hip drive 13' may therefore only allow movement of the leg forward and backward directions in a sagittal plane of motion, and may restrict movement of the leg outward and away from a midline of the body in a frontal plane of motion.

The hip drive 13' may be rigidly fixed at both sides of the waist portion 11'. The hip drive 13' may therefore not be able to guide a rotation of the hip joint along a direction of a multi-axis. When the user rotates the legs leftward and rightward in standing or sitting states, the hip drive 13' may not correctly deliver the first assistive force to the hip joint of the user.

Reference numerals 12 (FIG. 1) and 12' (FIG. 2) are thigh supports, reference numerals 15 (FIG. 1) and 15' (FIG. 2) are knee drives, and reference numerals 14 (FIG. 1) and 14' (FIG. 2) are shin supports. Referring to FIGS. 1 and 2, the thigh supports 12 and 12' may have a straight plate or shaft shape. These thigh supports 12 and 12' may not closely or completely contact a side of a thigh or a shin of a user, especially when they bend. Thus, the knee drives 15 and 15' may be spaced apart or partially spaced apart from a knee joint of the user.

When the user walks, a knee joint axis of the knee joint drives 15 and 15' installed between the thigh supports 12 and 12' and the shin supports 14 and 14' may deviate from a knee joint axis of the user, which may require a second assistive force. The second assistive force may therefore be partially lost and/or misapplied due to this deviation when provided to the knee joint of the user. A wearable robot as shown in FIGS. 1 and 2 may therefore not be able to achieve a desired effect or assistance.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

In this specification, an 'assistive force' may correspond to an external force additionally provided to compliment a user's natural motion or strength. The assistive force may be provided by, for example, an electric motor, a hydraulic pump, or actuator (hydraulic, pneumatic, or electrical). The assistive force may be a rotational force that moves the exoskeleton at its joints to correspond with a natural movement of the user (e.g., during walking, lifting, or bending).

Figure 3:
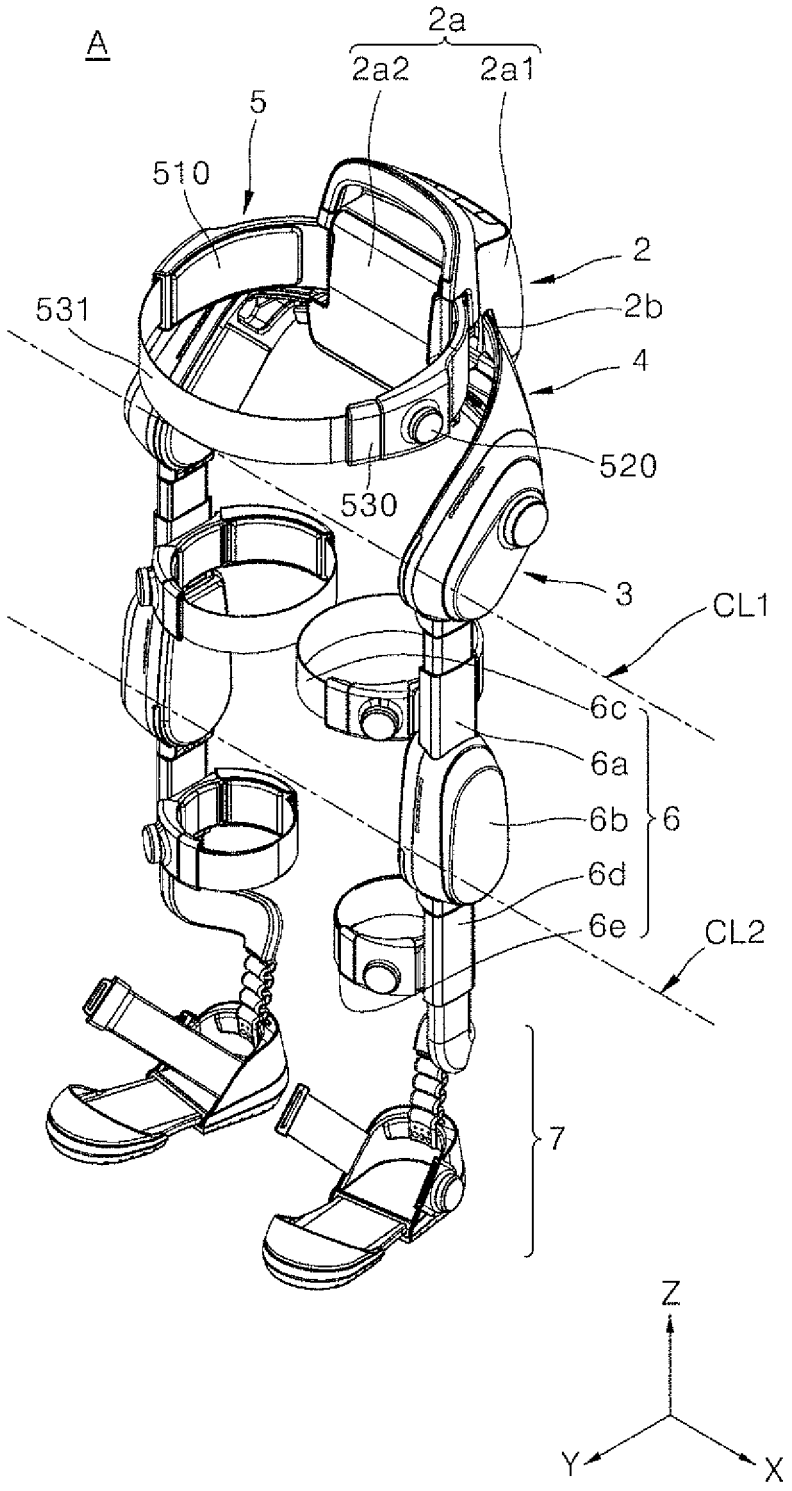
FIG. 3 is a perspective view showing a wearable assistive device such as an exoskeleton in accordance with an embodiment.
Figure 4:
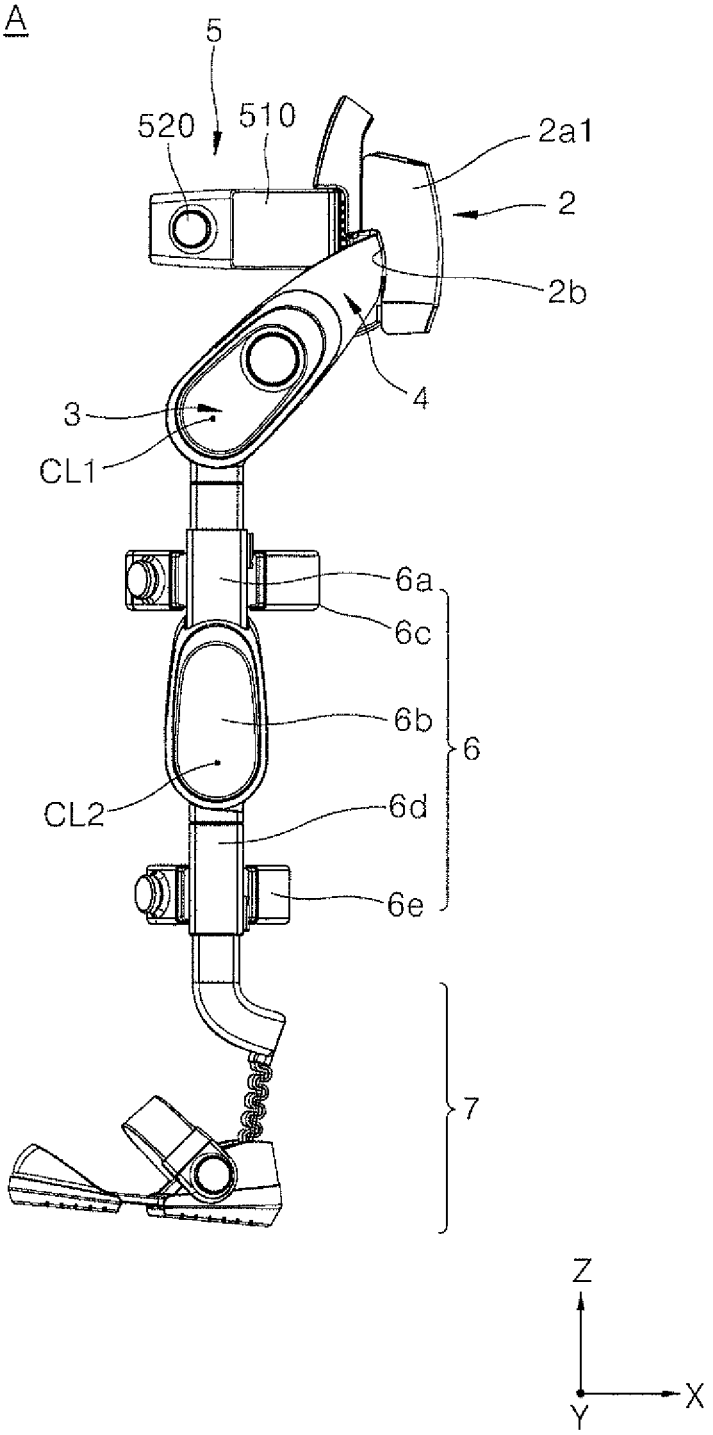
FIG. 4 is a side view showing the exoskeleton of FIG. 3.

FIG. 3 is a perspective view showing a wearable assistive device such as a wearable robot A, and more specifically an exoskeleton, in accordance with an embodiment. FIG. 4 is a side view showing the exoskeleton of FIG. 3. Referring to FIGS. 3 and 4, the exoskeleton A may be worn on a lower body of a user. The exoskeleton A may assist a lower body power or a lower body strength of the user. The exoskeleton A is not limited to a lower body exoskeleton and may instead be configured to be worn on an upper body or an entire body of the user. Further, the entire lower exoskeleton of FIGS. 3 and 4 may not be required based on an intended use of the exoskeleton.

Referring to FIGS. 3 and 4, the exoskeleton A may include a lumbar/back frame 2 housing a main controller to control a function of the exoskeleton A, an actuated hip joint 3, a main frame 4 that extends from the lumbar/back frame 2 and surrounds the hips of the user, a subframe or waist/pelvic frame 5, a leg or leg assembly 6 that is secured on a leg of a user, and a foot support or foot assembly 7 to secure a shoe or a foot of the user to the exoskeleton A.

Furthermore, embodiments disclosed herein may not be limited to a complete lower body exoskeleton based on an intended use of the exoskeleton. Referring to FIG. 5B, the actuated joint 6*b*, the lower leg frame 6*d*, the leg belt 6*e*, and the foot support 7 may be omitted. Thus, an exoskeleton A may provide assistance to the user at the actuated hip joint 3, and may include a main frame 4, a lumbar/back frame 2, and a leg assembly 6 that includes only an upper leg frame 6*a* that secures to a thigh of the user via a leg belt 6*c*. Such an upper leg exoskeleton A may have a hip structure substantially the same as or similar variations to the hip structure of the main frame 4 described in detail herein.

The lumbar/back frame 2 may be installed on the main frame 4 at a rear of the user. The main controller may be provided in the lumbar/back frame 2 and can adjust a width of the main frame 4 depending on a body size or body shape of the user. The lumbar/back frame 2 may also include a battery pack or power supply (not shown) to provide a power source that may be used to operate the exoskeleton A.

The waist/pelvic frame 5 may be provided at a rear of the user in front of the lumbar/back frame 2. The waist/pelvic frame 5 may support the waist of the user. The waist/pelvic frame 5 may secure to the waist of the user via a belt or strap which may be adjustable in length. The waist/pelvic frame 5 may include a shock absorbent material to improve comfort where the waist/pelvic frame 5 contacts the waist.

The main frame 4 may support the lumbar/back frame 2 having the main controller. The main frame 4 may extend from a first side, e.g., left side, of a pelvis of a user to a second side, e.g., right side. The main frame 4 may thus cover left, right, and rear sides of the user around the pelvis.

Figure 5A:
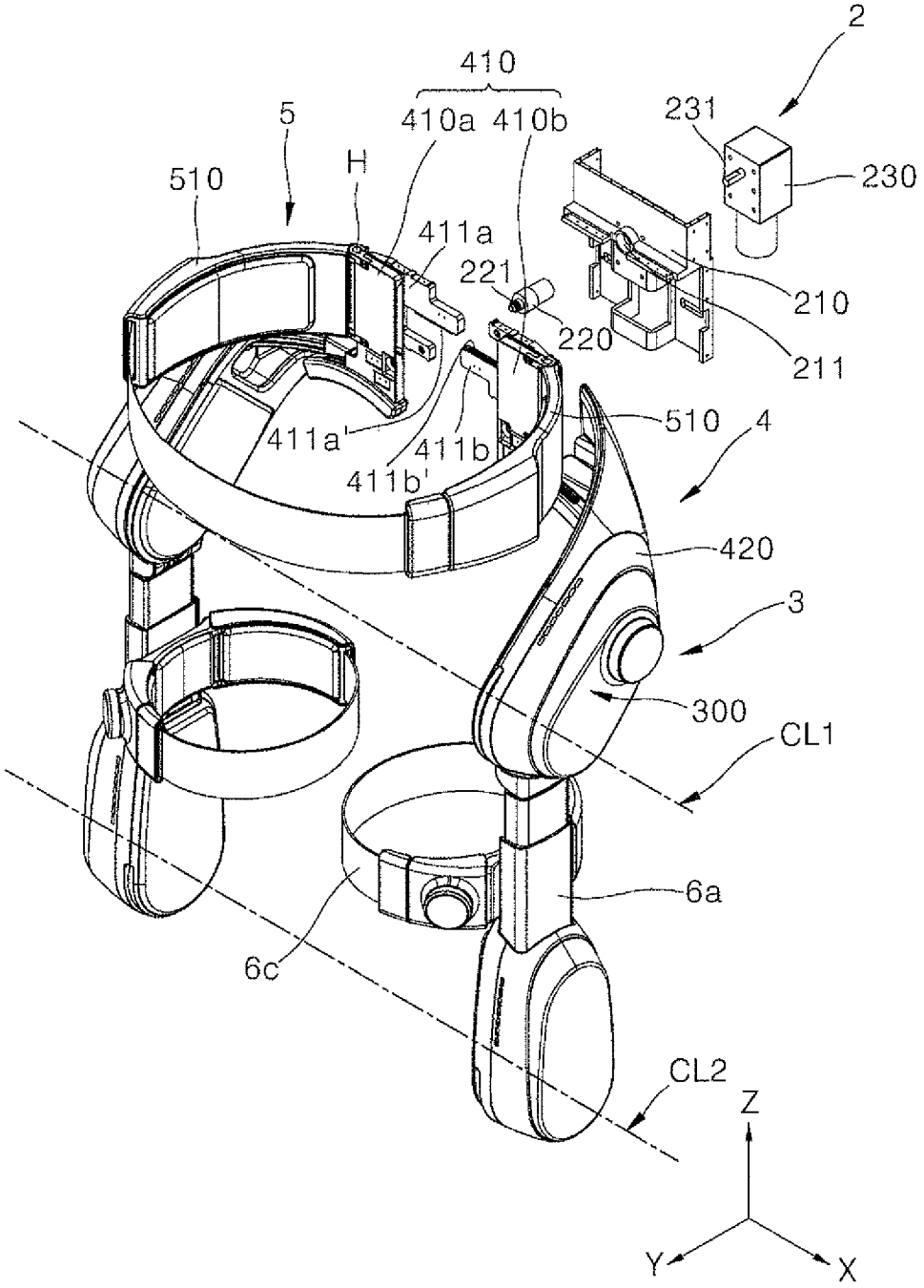
FIG. 5A is an exploded perspective view showing a coupling relationship between a waist support and a main frame in accordance with an embodiment.
Figure 5B:
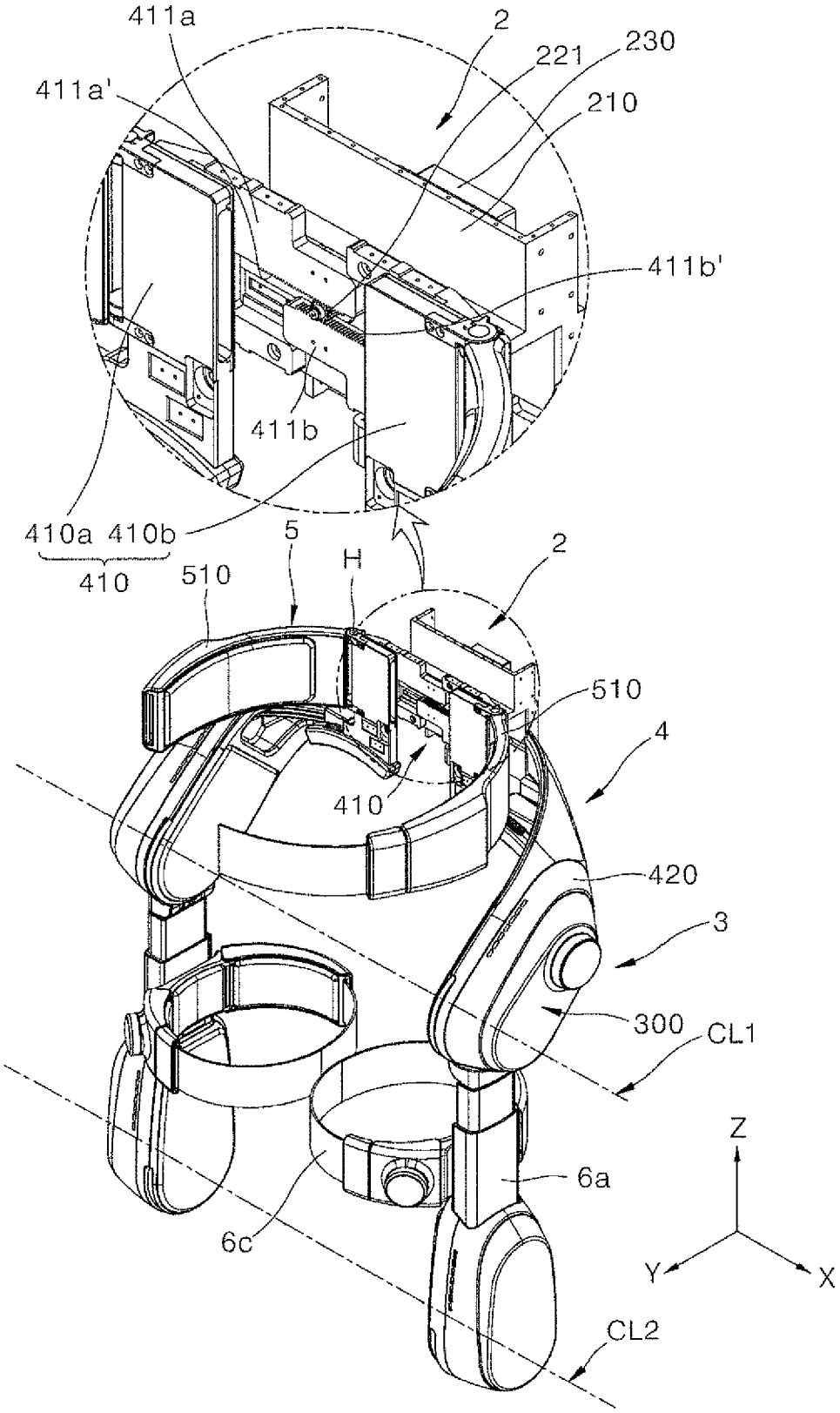
FIG. 5B is an exploded view showing a coupling relationship between a waist support and a main frame in accordance with an embodiment.

The lumbar/back frame 2 may be installed at a rear side of a waist support or waist support assembly 410 (see FIG. 5A). The waist support assembly 410 may be a rear center section of the main frame 4. The main frame 4 may further include a first frame, formed at a first side, e.g., left side, of the waist support 410, and a second frame formed at a second side, e.g., right side, of the waist support assembly 410. The first frame may be or include a first waist support 410*a* and the second frame may be or include a second waist support 410*b*.

The first and second frames with the waist support assembly 410 may together form an approximate 'U'-shape. Alternatively, the first and second frames with the waist support assembly 410 may be shaped to fit onto a user. A bent or curved portion of the 'U'-shaped main frame 4 may be provided at the rear side of the user where the lumbar/back frame 2 may be arranged. Positions of the first and second frames of the main frame 4 may be varied depending on a movement of a hip joint or hip of the user.

The first and second frames of the main frame 4 may extend downward along the hips or pelvis, e.g., ilium, of the user. The first and second frames may include first and second ends of the main frame 4 respectively. Further, both frames of the main frame 4 may be inclined. The actuated hip joint 3 may be provided at first and second ends of the main frame 4, while a subcontroller may be provided above the actuated hip joint 3 in the first and second frames. Details of control functions of the main controller of the lumbar/back frame 2 and the subcontroller of the actuated hip joint 3 are provided in U.S. application Ser. No. 16/274,584 filed on Feb. 13, 2019 and Ser. No. 16/274,613 filed on Feb. 13, 2019, the entire contents of which are incorporated herein by reference.

The subcontroller may adjust a strength or a magnitude of a first assistive force that assists the power or strength of the user. The first assistive force may be adjusted via a dial or knob. An indicator may be provided in the subcontroller or in the first and second frames of the main frame 4 to indicate a strength or magnitude of the first assistive force. The indicator may be a lamp, light, or light emitting device such as a light emitting diode (LED) such that the light may indicate the magnitude of the assistive force.

A hip drive 300 (see FIG. 5A) may be installed at the actuated hip joint 3. The hip drive 300 may include an actuator (hydraulic, pneumatic, or electric) or a motor and gear set, for example. The hip drive 300 may generate a first rotational force about a hip drive axis (CL1) which may correspond to a hip joint rotation of the exoskeleton A at the actuated hip joint 3. The first rotational force may be the first assistive force, and the hip drive 300 may be provided such that the hip drive axis CL1 aligns with a hip joint axis of a user (ML1 in FIG. 11) or, alternatively, a lower pelvic axis of a user provided at or below a center of the hip joint of the user. Therefore, the hip drive 300 can provide the first assistive force to the leg assembly 6 of the exoskeleton A at the hip of the user.

The leg assembly 6 may be worn on a leg of the user. There may be two leg assemblies 6, each worn on a leg of the user. Each leg assembly 6 may include an upper leg frame 6*a* that may be secured to a thigh via a leg belt or strap 6*c*, an actuated joint 6*b*to provide a second assistive force, and a lower leg frame 6*d* that may be secured to a calf of a user via a leg belt or strap 6*e*. Details of the leg belts 6*c* and 6*e* may be found in U.S. Application Serial No. 16/282,409 filed on Feb. 22, 2019 and Ser. No. 16/352,920 filed on Mar. 14, 2019, the entire contents of which are incorporated by reference herein. The actuated joint 6*b* may be provided between the upper leg frame 6*a* and the lower leg frame 6*d*.

Figure 11:
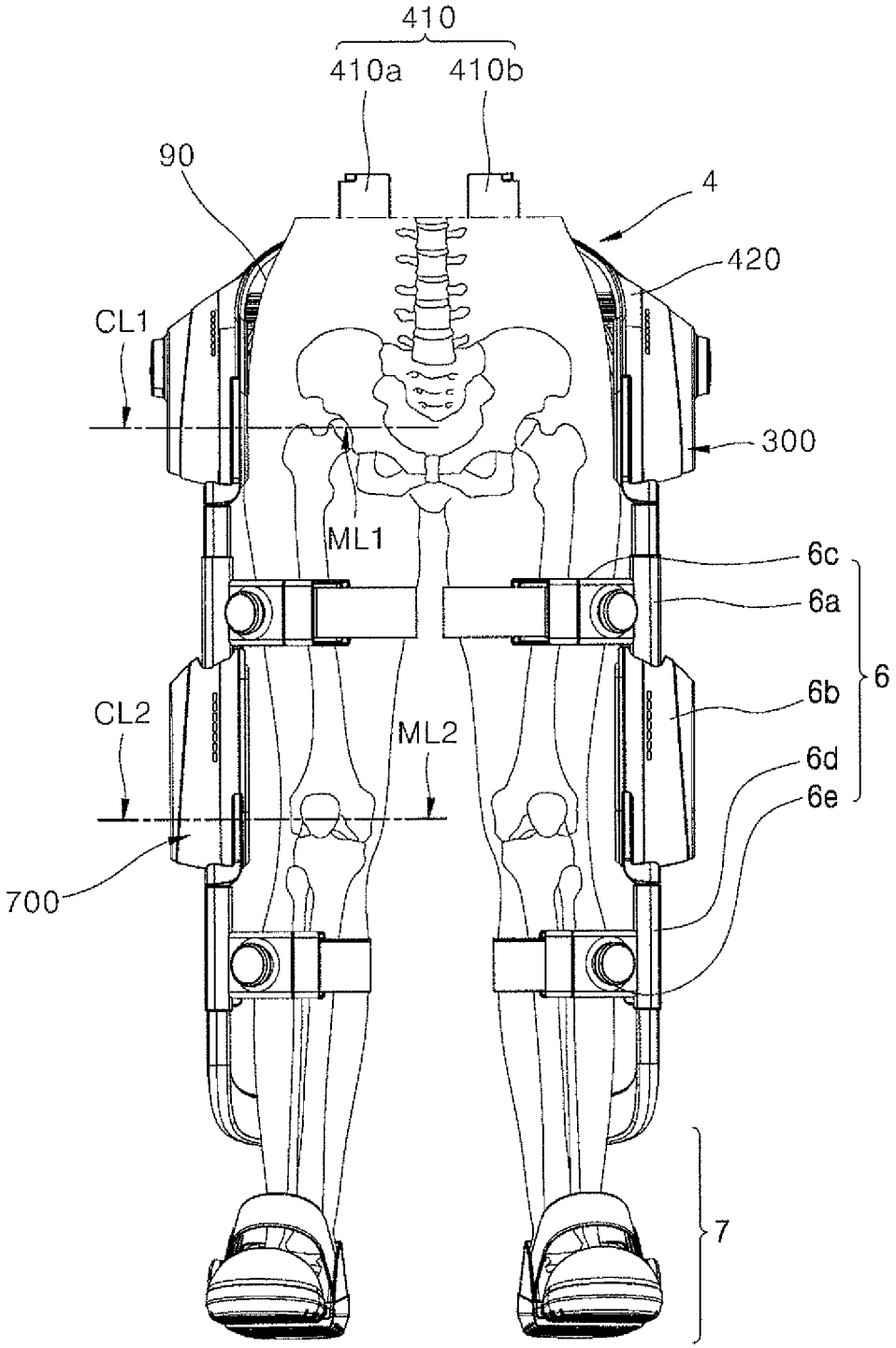
FIG. 11 is a perspective view showing a state before a lower body of a user is rotated or moved while the user wears an exoskeleton.

A knee drive 700 may be installed at the actuated joint 6*b* (see FIG. 11). The knee drive 700 may include an actuator (pneumatic, electric, or hydraulic) or a motor and a gear set, for example. The knee drive 700 may generate a second rotational force about a knee drive axis (CL2) that may correspond to a knee joint movement of the exoskeleton A at the actuated joint 6*b*. The second rotational force may be the second assistive force. The knee drive 700 may be provided such that the knee drive axis CL2 aligns with a knee joint center axis of the user (ML2 in FIG. 11). Therefore, the knee drive 700 may provide the second assistive force to assist with a knee movement of the user at the knee joint. The knee drive 700 may include various configurations capable of generating an assistive force.

The upper leg frame 6*a* and the lower leg frame 6*d* may rotate with the actuated hip joint 3 and the actuated joint 6*b*, respectively, in directions corresponding to a direction of hip and knee joint movements of the user. The user's natural hip joint movement may be assisted by the first assistive force provided by the hip drive 300 at the actuated hip joint 3, and the user's natural knee movement may be assisted by the second assistant force provided by the knee drive 700 at the actuated joint 6*b*. Thus, the knee drive 700 may provide a sufficient force to rotate the lower leg frame 6*d* of the exoskeleton A along with a lower leg of the user. The hip drive 300 may provide a sufficient force to rotate the upper leg frame 6*a*, the lower leg frame 6*d*, and the upper and lower legs of the user.

The upper leg frame 6*a* may be configured to closely contact an outside of the thigh of the user. The upper leg frame 6*a*, the actuated joint 6*b*, and the lower leg frame 6*d* may align with an outer side of the leg of the user. As a result, the exoskeleton A may bend and fold without interfering with a natural bending motion of the user so that a user may conveniently move his or her joints while walking, bending, or lifting. The upper leg frame 6*a* can be extended outward by a predetermined angle by a hip joint structure of the main frame 4 to be described later. Further, the upper leg frame 6*a* and the lower leg frame 6*d* may have a multi-joint structure to be described later. The multi-joint structure may be a structure capable of adjusting the angle inward and outward, corresponding to a natural inclination of the leg of the user.

The foot support 7 may secure and support a shoe or a foot of the user via a strap, and may be coupled to a lower end of the lower leg frame 6*d*. The foot support 7 may be adjustable in length to accommodate various foot sizes. The foot support 7 may, for example, have front and rear supports slideably coupled to each other. Further, the foot support 7 may have a strap to secure an upper surface of the shoe or foot of the user. Details of the foot support 7 may be found in U.S. application Ser. No. 16/274,560 filed on Feb. 13, 2019 and Ser. No. 16/274,798 filed on Feb. 13, 2019, the entire contents of which are disclosed herein by reference.

Although not shown, embodiments disclosed herein may not be limited to a complete lower body exoskeleton. For example, the actuated joint 6*b*, the lower leg frame 6*d*, the leg belt 6*e*, and the foot support 7 may be omitted. Thus, an exoskeleton A may provide assistance to the user at the actuated hip joint 3, and may include a main frame 4, a lumbar/back frame 2, and a leg assembly 6 that includes only an upper leg frame 6*a* that secures to a thigh of the user via a leg belt 6*c*. Such an upper leg exoskeleton A may have a hip structure substantially the same as or similar variations to the hip structure of the main frame 4 described in detail herein.

Referring to FIGS. 5A and 5B, an exoskeleton A may include a waist support assembly 410 provided over a waist or pelvis of a user. The waist support assembly 410 may include a first waist support 410*a* and a second waist support 410*b*. The first and second waist supports 410*a* and 410*b* may together form a plate shape at a rear of the user. The waist support assembly 410 may be configured to closely contact the waist or pelvis of the user. An area of the plate shape of the waist support assembly 410 may be predetermined according to a size of the user. Thus, the waist support assembly 410 can be manufactured to have various sizes. A space between the first and second waist supports 410*a* and 410*b* may be adjustable so that a size of the manufactured waist support assembly 410 may be further customized.

The first waist support 410*a* may have a first rack 411*a*. The first rack 411*a* may be projected from an inner end or side of the first waist support 410*a*. The second waist support 410*b* may have a second rack 411*b* projected from an inner end or side of the second waist support 410*b*. The first rack 411*a* and the second rack 411*b* may be projected toward each other. The first rack 411*a* and the second rack 411*b* may be spaced apart from each other by a predetermined distance along the vertical or z-axis direction. The first rack 411*a* may be arranged above the second rack 411*b*. A first gear tooth set 411*a*' may be formed at a lower end of the first rack 411*a*. A second gear tooth set 411*b*' may be formed on an upper end of the second rack 411*b*. Therefore, the first and second gear tooth sets 411*a*' and 411*b*' may face each other in the vertical direction.

The lumbar/back frame 2 may be arranged behind first and second waist supports 410*a* and 410*b*. The first waist support 410 may be connected to the first frame of the main frame 4, and the second waist support 410*b* may be connected to the second frame of the main frame 4. The first and second frames of the main frame 4 may face each other when the main frame 4 is not secured to a user. The main frame 4 may be connected to each of the first and second waist supports 410*a* and 410*b* through a hip joint matching unit or hip matching assembly 430 (see FIG. 6) to be described hereinafter. The lumbar/back frame 2 may have a rear body 210 arranged behind or at a rear side of the first and second waist supports 410*a* and 410*b*. A through hole 211 may be formed in the rear body 210.

A motor 230 that generates a power may be installed in the rear body 210. The motor may have a shaft 231 that rotates when the power is generated. The shaft 231 of the motor 230 may penetrate the through hole 211 of the rear body 210 and may be provided between the first and second waist supports 410*a* and 401*b*. The shaft 231 may be connected to a gear rod 220. The gear rod 220 may be formed in a circular rod shape. The shaft 231 of the motor 230 may be coupled to a first end the gear rod 220. For example, the shaft 231 may be pressed/friction fitted into the gear rod 220. The first end of the gear rod 220 may have a pinion gear 221. The pinion gear 221 may be projected from a second end of the gear rod 220. The pinion gear 221 may be arranged between the first rack 411*a* and the second rack 411*b*. The pinion gear 221 may be gear-connected to the first and second racks 411*a* and 411*b* via a gear method described with reference to FIG. 5B.

The shaft 231 may be rotated by a driving of the motor 230. The gear rod 220 coupled to the shaft 231 may then be rotated. At the same time, the pinion gear 221 projecting from the second end of the gear rod 220 may be rotated. The first and second racks 411*a* and 411*b* may linearly move along the horizontal or x-axis direction while being connected to the pinion gear 221 via a gear method.

Referring to FIG. 5B, the pinion gear 221, which may project from the motor 230 toward a front of the main frame 4, may include teeth on an outer circumferential surface. The teeth of the pinion gear 221 may engage with the teeth of the first gear tooth set 411*a*' and the second gear tooth set 411*b*'. The pinion gear 221 may be inserted between the first and second racks 411*a* and 411*b*. The first and second racks 411 and 411*b* may be spaced apart a predetermined distance that corresponds to a diameter or size of the pinion gear 221. The size of the teeth in the first tooth set 411*a*' and the second tooth set 411*b*' may correspond to a size of the teeth on the pinion gear 221.

When the pinion gear 221 is rotated in a first or opening direction, the teeth in the first and second tooth sets 411*a*' and 411*b*' may move in a horizontal direction such that the first and second racks 411*a* and 411*b*, and thus the first and second waist supports 410*a* and 410*b*, move away from each other, increasing the size of the waist support assembly 410. When the pinion gear 221 is rotated in a second or closing direction, the teeth in the first and second gear tooth sets 411*a*' and 411*b*' may move in a horizontal direction such that the first and second racks 411*a* and 411*b*, and thus the first and second waist supports 410*a* and 410*b*, move toward each other, decreasing the size of the waist support assembly 410.

The first and second racks 411*a* and 411*b* may be interlocked according to the opening or closing directions while the shaft 231 of the motor 230 rotates. The first and second racks 411*a* and 411*b* of the waist support assembly 410 may thus be coupled to the shaft 231 of the motor 230 of the lumbar/back frame 2. There may further be an optional plate (not shown) fixed between the main frame 4 and the lumbar/back frame 2 to further secure the main frame 4 to the lumbar/back frame 2.

The lumbar/back frame 2 may include a cover portion or a cover 2*a*. The cover 2*a* may include an outer cover 2*a*1 and an inner cover 2*a*2. The rear body 210 and the motor 230 may be provided inside the cover 2*a*. As an example, the rear body 210 and the motor 230 may be provided between the outer cover 2*a*1 and the inner cover 2*a*2. In an alternative embodiment, the rear body 210 and the motor 230 may be provided in the outer cover 2*al*. There may be an opening in the outer cover 2*al* through which the pinion gear 221 may be inserted to couple to the first and second racks 411*a* and 411*b* of the main waist assembly 410.

The main frame 4 and the waist/pelvic frame 5 may be partially provided in the cover 2*a* between the outer cover 2*al* and the inner cover 2*a*2. The cover 2*a* may be formed to have guide slots or holes 2*b* at first and second, i.e., left and right, sides. The guide slots 2*b* may be an opening or space between the outer cover 2*al* and the inner cover 2*a*2. Alternatively, each of the outer cover 2*a*1 and the inner cover 2*a*2 may include a set of guide slots 2*b* that communicate with each other. First and second frames or sides of the main frame 4 may be fitted into the guide slots 2*b*. For example, first and second waist supports 410*a* and 410*b* may be inserted into the guide slots 2*b*.

The guide slots 2*b* may be configured to allow a movement of the main frame 4 within the cover 2*a*. In other words, a width of the main frame 4 may be adjusted within the cover 2*a* when a distance between the first and second waist supports 410*a* and 410*b* is adjusted. The cover 2*a* may be further configured to allow a movement of the hip matching assembly 430 (FIG. 6), which may be partially provided within the cover 2*a* between the inner and outer covers 2*al* and 2*a*2.

The outer cover 2*a*1 may engage with the inner cover 2*a*2. As an example, a top and bottom of the outer cover 2*a*1 may be coupled to a top and bottom of the inner cover 2*a*2, but embodiments disclosed herein are not limited to such a coupling between the outer and inner covers 2*al* and 2*a*2. Thus, the waist support assembly 410 of the main frame 4 may be supported by the cover 2*a*.

The waist/pelvic frame 5 may be fixed to the first and second waist supports 410*a* and 410*b* of the waist support assembly 410 of the main frame 4. The waist/pelvic frame 5 may be a waist belt having a first support 510 from which at least one belt 531 is withdrawn, a buckle 530 provided on an end of the belt 531, and a second support 520 having a button dial which couples to the buckle 530 of the belt 531. Details of the waist belt may be found in U.S. Application Serial Nos. 16/352,940 filed on Mar. 14, 2019, Ser. No. 16/274,662 filed on Feb. 13, 2019, and Ser. No. 16/274,697 filed on Feb. 13, 2019, the entire contents of which are incorporated by reference herein. There may be two or more waist frames, or alternatively, a waist frame having at least two belts assemblies, each consisting of a belt 531 and a buckle 530, a first support 510, and a second support 520 having a button dial.

The first and second supports 510 and 520 may be coupled to the first and second waist supports 410*a* and 410*b*, respectively. As an example, the first and second supports 510 and 520 may be hingedly coupled to the first and second waist supports 410*a* and 410*b*. The cover 2*a* may be configured so as not to restrict or interfere with a movement of the waist/pelvic frame 5 about hinges that couple the waist/pelvic frame 5 to the main frame 4.

The waist/pelvic frame 5, together with the main frame 4, may therefore be partially provided in the cover 2*a* between the outer and inner covers 2*a*1 and 2*a*2 in guide slots 2*b*. In an alternative embodiment, the first and second supports 510 and 520 may be inserted into guide slots or openings of the inner cover 2*a*2, while the hip matching assembly 430 of the main frame 4 may be partially provided in guide slots 2*b* of the outer cover 2*a*1. Inside the cover 2*a*, the first and second supports 510 and 520 may couple to the main frame 4 by coupling to the first and second waist supports 410*a* and 410*b*, respectively.

When the main controller controls the motor 230 to increase the width of the main frame 4, the leg assemblies 6 that extend from ends of the main frame 4 may be spaced further apart. When the main controller controls the motor 230 to decrease the width of the main frame 4, the leg assemblies 6 may be close together. Thus, the main controller may control a distance between the two leg assemblies 6.

Figure 5C:
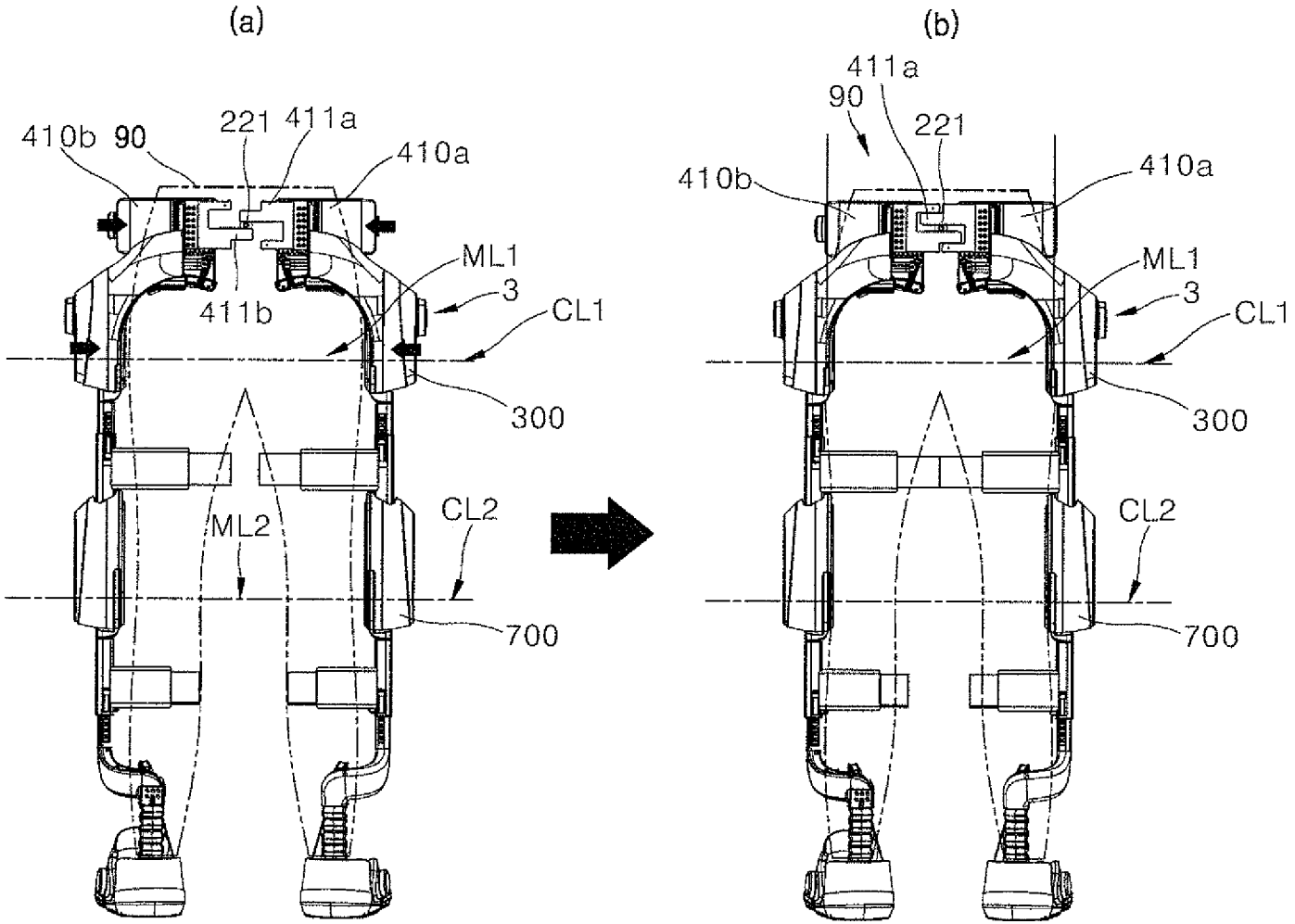
FIG. 5C is a view showing a process in which a main frame in accordance with an embodiment is adjusted to contact to a hip of a user.

FIG. 5C is a view showing a process in which a main frame may adjust in size to closely contact a side of a hip of a user. In view (a), the first and second waist supports 410*a* and 410*b* may not closely or completely contact both sides of the hip joint of the user due to a distance between them.

The main controller of the lumber/back frame 2 may adjust the distance between the first and second waist supports 410*a* and 410*b*. As shown in view (b) of FIG. 5C, the main controller may control the motor 230 to move the first and second racks 411*a* and 411*b* to narrow or widen the space between the first and second supports 410*a* and 410*b* and thus decrease or increase the distance between them. Therefore, the first and second waist supports 410*a* and 410*b* may be adjusted to conform to a size of a waist and a hip of a user so that the main frame 4 closely and/or correctly secures to the user.

As described above, the space between the first and second waist supports 410*a* and 410*b* may be variably adjusted. Accordingly, the main frame 4 may stably support both sides of the hip joint of the user by being able to adjust to sizes corresponding to various hip or pelvis sizes of the user. Further, when the user moves (e.g., walks, lifts, or bends), the main frame 4 may not deviate from a hip joint supporting position of the user, or a section of the user on which the main frame 4 is supported, as the first and second waist supports 410*a* and 410*b* may not deviate or be displaced from the hip or the pelvis of the user. The more secure the main frame 4 is on the user, the better the delivery of the first assistive force, which is configured to lift both the leg assembly 6 of the exoskeleton A and also the leg of the user.

Figure 6:
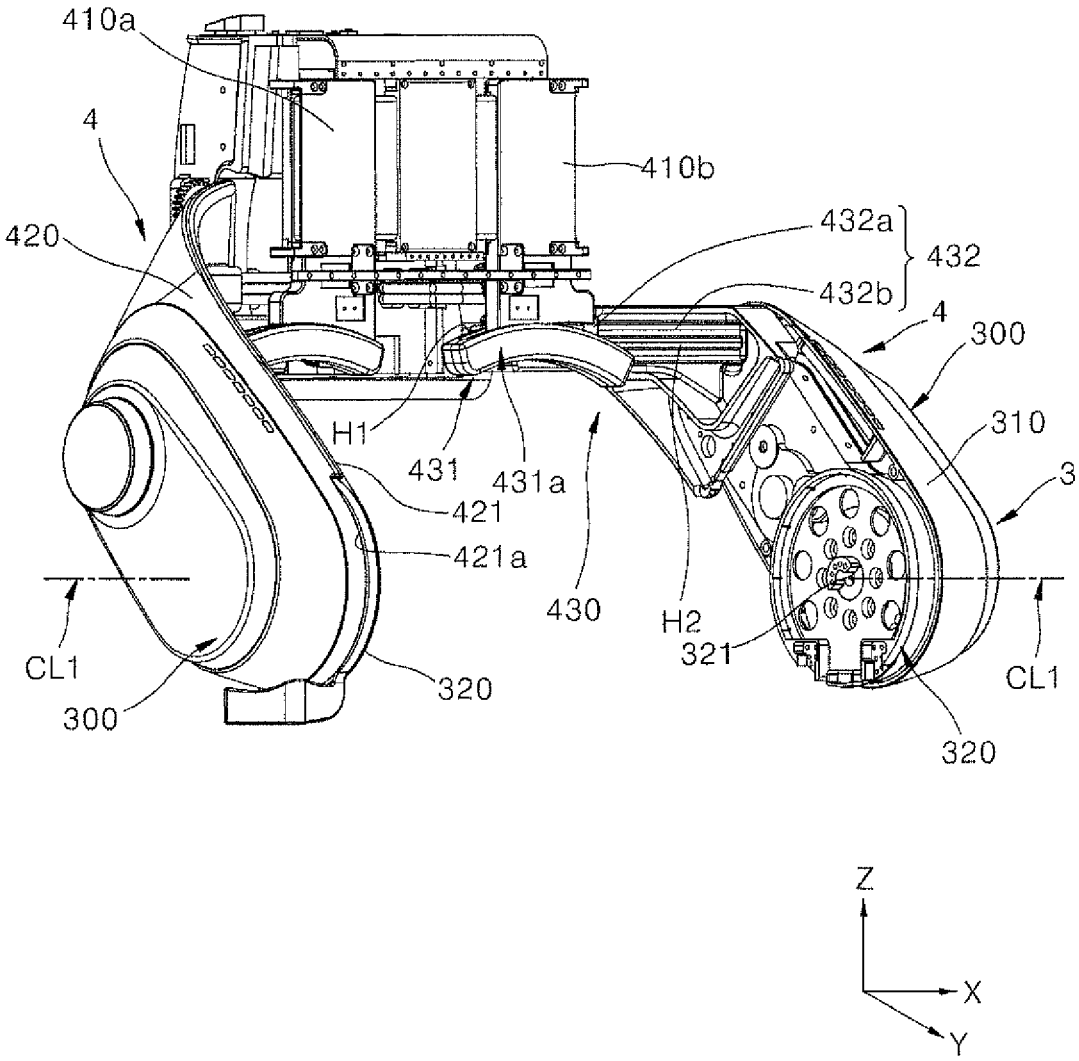
FIG. 6 is a perspective view showing a configuration of a waist support and a main frame in accordance with an embodiment.

FIG. 6 is a perspective view showing a coupling relationship between a waist support assembly 410 and a main frame 4 in accordance with an embodiment. Referring to FIG. 6, a main frame 4 may have a predetermined curvature so as to cover or wrap around a waist and/or pelvis of a user. The main frame 4 may include first and second frames to form a curve.

Each of the first and second frames of the main frame 4 may have a cover or extension 420. The extension 420 may have a predetermined curvature to cover a pelvis or ilium of a user. Alternatively, the extension 420 may have an inner shape corresponding to an external shape of a pelvis or hip of the user. The extension 420 may be formed of a plastic resin or elastic material. The extensions 420 on the first and second frames of the main frame 4 may be manufactured to have different curvatures from each other according to an external shape of the pelvis of the user.

A contact buffer or cushion 421 may be installed at an inner side of the extension 420. The contact buffer 421 may be formed of an elastic or polymer material. Alternatively, an entire inner side of the extension 420 may be formed of an elastic or polymer material. Therefore, the contact buffer 421 may closely or completely contact a side of the hip of the user, and the extension 420 may not slip. The contact buffer 421 and the extension 420 may be manufactured separately or formed integrally. The contact buffer 421 and/or the extension 420 may have a predetermined elasticity to press to or from around the pelvis of the user. The contact buffer 421 and/or the extension 420 may thus conform to the shape of the pelvis or hip of the user such that the contact buffer 421 and/or the extension 420 may remain in contact with the user and may not be easily displaced.

The first and second frames of the main frame 4 may include a hip drive 300. The hip drive 300 may provide the first assistive force to the upper leg frame 6*a* to assist the user in lifting his leg at the hip joint The hip drive 300 may include a drive 310 such as a motor or actuator (electric, pneumatic, or hydraulic). The drive 310 may have a rotation shaft 321 that is rotated in accordance with the first assistive force, and a rotation plate 320 that connects to the rotation shaft 321 and interlocks with a rotation of the rotation shaft 321. The rotation shaft 321 may be a motor shaft rotated by the motor. The rotation plate 320 may be a rotating plate connected to the rotation shaft 321 and rotated. The rotation plate 320 may closely contact the hip of the user at the hip joint axis of a user (ML1 in FIG. 11) and provide the first assistive force. Here, the rotation shaft 321 may form a hip drive axis CL1 of the main frame 4.

A groove or recess 421*a* may be formed in the contact buffer 421. The groove 421*a* may form a space in which the rotation plate 320 may be provided. Therefore, the groove 421*a* may be cut or formed along an inside of the extension 420 where the rotation plate 320 may be arranged. The rotation plate 320 may partially project from the groove 421*a* and thus be partially exposed at an end of the main frame 4.

The rotation plate 320 may be rotated about the rotation shaft 321. The rotation plate 320 may closely or completely contact a hip joint side of the user and provide the first assistive force. The first assistive force may be a rotational force about an X axis. The rotation plate 320 may be coupled to the upper leg frame 6*a* to rotate the upper leg frame 6*a* with a thigh of the user that is secured to the upper leg frame 6*a* via the leg belt 6*c*. The upper leg frame 6*a* may therefore have a rotation range based on an arc length of the groove 421*a*.

An elastic member or plate (not shown) of a flexible material may be installed on an outer surface of the rotation portion 320. The elastic member may closely or completely contact the hip joint side of the user. The elastic member and the hip joint or hip of the user may thus not slip relative to each other, so the elastic member may remain in contact with the user and may not be easily displaced. Therefore, the first assistive force may not be misapplied when assisting a movement of the user originating in the hip joint. The first and second frames of the main frame 4 can therefore easily be secured at a position on the user that corresponds to his hip joint; i.e., "the hip joint supporting position". The exoskeleton A may be stably and conveniently worn on the body of the user and allow the user to stably walk.

Figure 7:
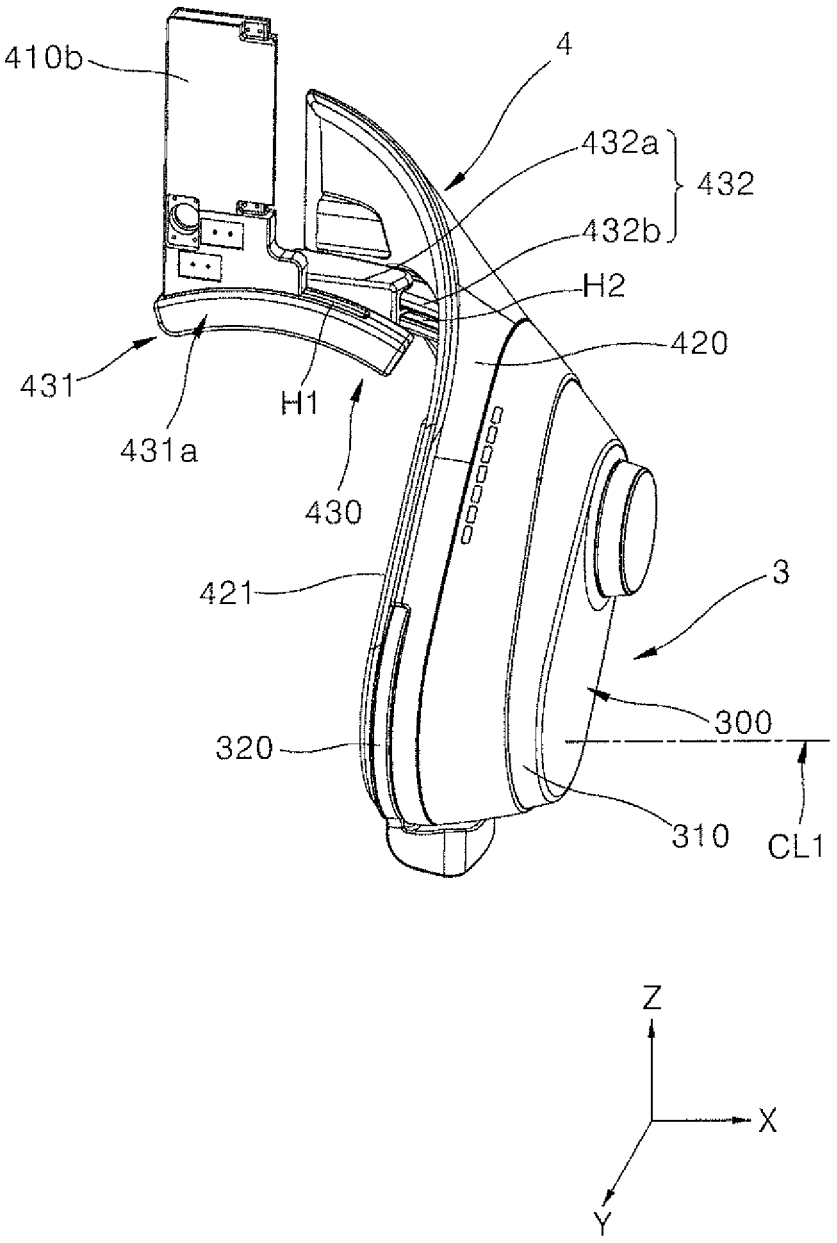
FIG. 7 is a perspective view showing a configuration of a main frame having a hip matching assembly in accordance with an embodiment.
Figure 8:
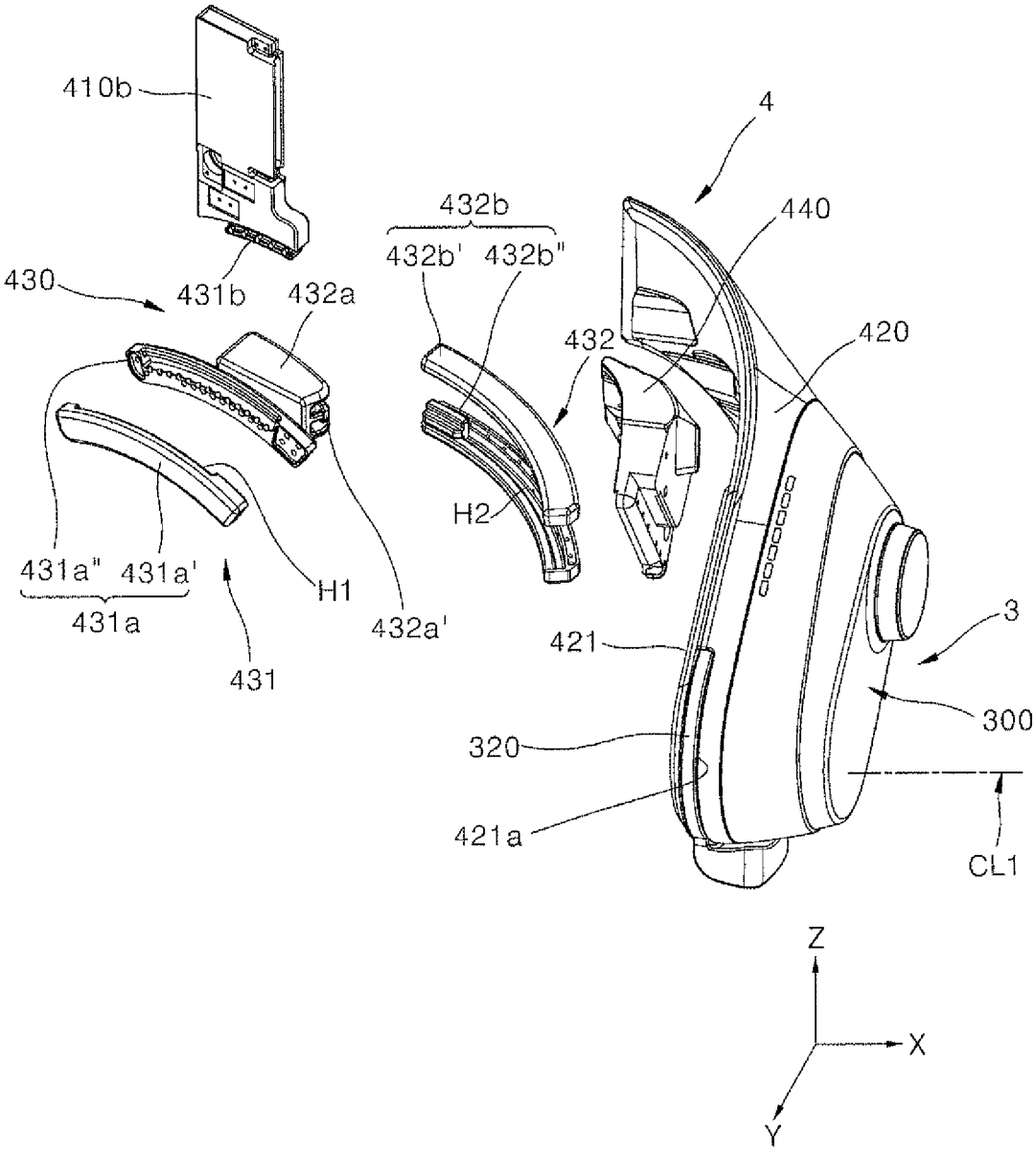
FIG. 8 is an exploded perspective view showing a configuration of a main frame having a hip matching assembly in accordance with an embodiment.
Figure 9:
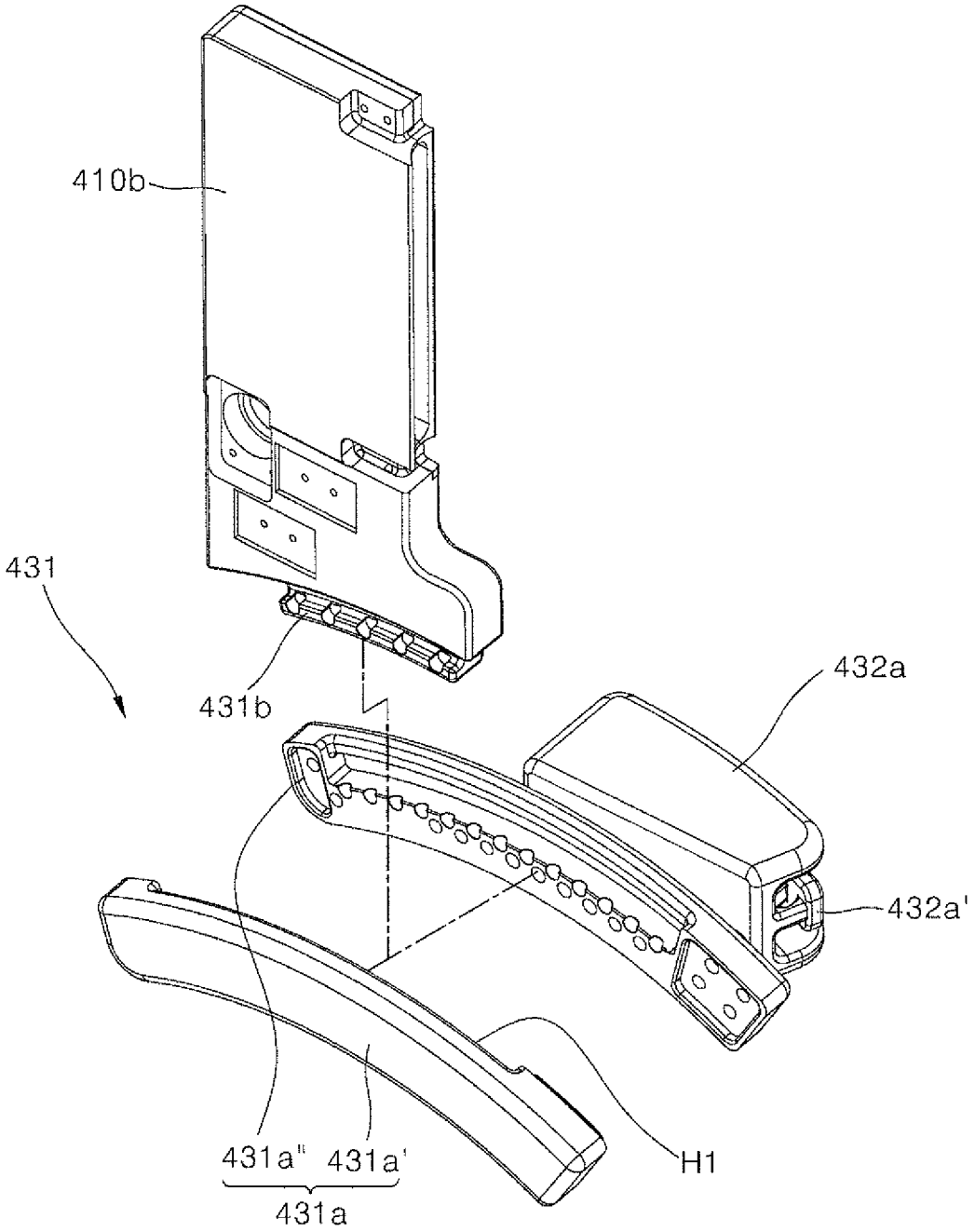
FIG. 9 is an enlarged perspective view showing a configuration of a first rail portion of FIG. 8.
Figure 10A:
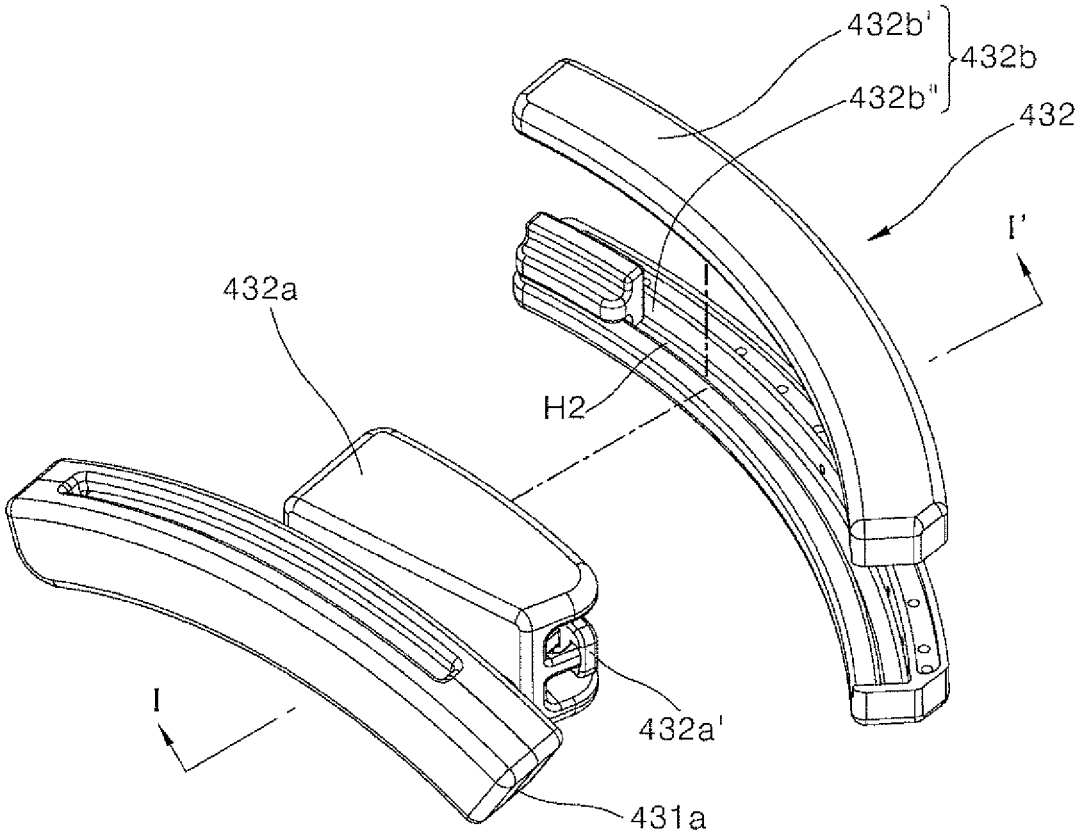
FIG. 10A is an enlarged perspective view showing a configuration of a second rail portion of FIG. 8.
Figure 10B:
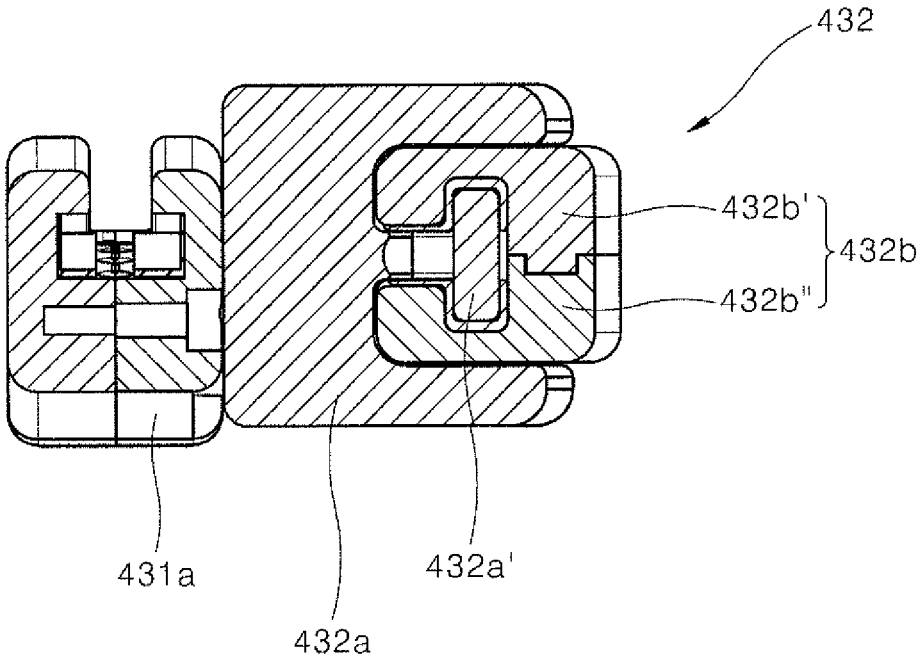
FIG. 10B is a cross-sectional view taken along line A-A in FIG. 10A.

FIG. 7 is a perspective view showing a configuration of a main frame 4 having a hip matching assembly 430 in accordance with an embodiment. FIG. 8 is an exploded perspective view showing the configuration of the main frame 4 having the hip matching assembly 430. Referring to FIGS. 6 and 7-10, an exoskeleton A may include a waist support assembly 410, a first frame and second frame of the main frame 4, and a hip matching assembly 430. A configuration of the waist support assembly 410 and the pair of frames of the main frame 4 may be substantially the same as those of the above-mentioned first embodiment, and thus a description thereof will be omitted. FIG. 9 is an enlarged perspective view showing a configuration of a first rail portion of FIG. 8. FIG. 10A is an enlarged perspective view showing a configuration of a second rail portion of FIG. 8. FIG. 10B may be a cross-sectional view taken along line A-A in FIG. 10A.

Referring to FIGS. 7 and 8, the hip matching assembly 430 may be installed in the pair of frames of the main frame 4. The hip matching assembly 430 may include a first or front rail portion or assembly 431, a second or rear rail portion or assembly 432, and a rotation plate 320. The pair of frames of the main frame 4 may be formed identically or similarly. Therefore, in the following description, any one frame of the main frame 4 will be described as a representative example. The first and second rail assemblies 431 and 432 of the hip matching assembly 430 may be replaceable.

Referring to FIGS. 8 and 9, the first rail assembly 431 may include a first guide member 431*a* and a first rail member 431*b*. A first guide hole or groove H1 may forma "movement section" in the first guide member 431*a*. The first guide member 431*a* may include a pair of bodies 431*a*' and 431*a*". The first guide groove H1 may be formed between grooves of the bodies 431*a*' and 431*a*" when the bodies 431*a*' and 431*a*" are coupled together. The first guide member 431*a* may have a predetermined curvature having a predetermined radius extending in the XZ-plane and rotated about the Y-axis. The curvature of the first guide member 431*a* may be manufactured to closely or completely contact a rear hip or pelvis near the buttocks of the user.

The first rail member 431*b* may be formed at a lower end or bottom of the second waist support 410*b*. The first rail member 431*b* may be coupled to the first guide groove H1 via a rail method so as to be moveable or slidable. The first rail member 431*b* may slide along the first guide groove H1 of the guide member 431*a*, and/or the first guide member 431*a* may slide relative to the first rail member 431*b*. The second waist support 410*b* may remain firmly fixed to the main frame 4, and the first guide member 431*a* may move relative to a lower end of the second waist support 410*b*.

A shape and size of the first rail member 431*b* may be configured to fit within the grooves of the first guide groove H1 so that the first guide member 431*a* and first rail member 431*b* may slide relative to each other. A size of the first guide groove H1 may determine a size of the moveable range of the first guide member 431*a* about the first rail member 431*b*. The pair of bodies 431*a*' and 431*a*" may be detachably coupled to form the first guide groove H1 where the first rail member 431*b* is inserted, and the first guide member 431*a* can be detachable from the first rail member 431*b*. Ends of the bodies 431*a*' and 431*a*" may be configured to restrict or maintain a movement of the first guide member 431*a*.

When a lower body of the user is extended outward, e.g., to the left or right, while the user wears the waist support assembly 410, the hip or leg of the user may be rotated about a Y-axis of the hip joint. Since the first rail member 431*b* may be provided along the first guide groove H1 between the pair of bodies 431*a*' and 431*a*" (FIG. 9), the first rail member 431*b* may be moved along the first guide groove H1 of the first guide member 431*a* in a curved path when the user extends his lower body outward. The first rail assembly 431 may guide a pivot motion of an extension 420 about the Y-axis. When the hip joint of the user has the Y-axis as its rotation center (i.e., when the user extends his legs back inward toward his body), a corresponding frame of the first and second frames of the main frame 4 may be pivotable or moveable along the Y-axis. Thus, the hip matching assembly 430 may accommodate outward and inward movement of the legs in the frontal plane (i.e., abduction or adduction) as the hip joint and main frame 4 rotates around the Y-axis.

The first rail assembly 431 can be guided by a movement of the hip joint supporting position of the user as the lower body of the user moves his legs leftward and rightward such that his hip joint rotates about the Y-axis. When the user moves to extend his lower body to the left and right, the hip joint supporting position may be varied by a varying motion of the hip joint. Since the main frame 4 may remain securely on the user during movement, the extension 420 of the main frame 4 may not deviate from the hip joint supporting position of the user, and so may move according to a movement of the hip joint of the user.

The second rail assembly 432 may connect the first rail assembly 431 to the main frame 4. The second rail assembly 432 may include a second guide member 432*b* and a second rail member 432*a*. The second rail member 432*a* may be formed behind the first guide member 431*a* to protrude from a rear side of the first guide member 431*a*.

The second guide member 432*b* may be fixed to an inside or inner side of the extension 420 of the main frame 4, either directly or via an optional coupling member 440 to be described later. The second guide member 432*b* may have a predetermined curvature. A second guide hole or groove H2 may form a "movement section" in the second guide member 432*b*, and may be formed in an inner side circumference of the second guide member 432*b*. The second guide member 432*b* may include a pair of bodies 432*b*' and 432*b*". The second guide groove H2 may be formed between grooves of the bodies 432*b*' and 432*b*" when the bodies 432*b*' and 432*b*" are secured together. The second guide groove H2 may face a direction perpendicular to the direction the first guide groove H1 faces.

The curvature of the second guide member 432*b* may form a curvature corresponding to a curvature of a rear of the hip or pelvis of the user. The second guide member 432*b* may be positioned closer to a side of the user than the first guide member 431*a*. The curvature of the second guide member 431*b* may have a predetermined radius extending in the XY-plane and rotating about the Z-axis. Further, the second guide member 432*b* can be manufactured so as to cover various sizes and curvatures of the user.

The second rail member 432*a* may be coupled to the second guide groove (H2) via a rail method and may be movably or slideably arranged. The second rail member 432*a* may be provided between the pair of bodies 432*b*' and 432*b*" of the second guide member 432*b* to move along the second guide groove H2. The ends of each body 432*b*' and 432*b*" may be configured to restrict a movement along the second guide groove H2 so that the length of the second guide groove H2 corresponds to a range of motion of the second rail member 432*a*. The second guide member 432*b* may be installed in the extension 420 of the main frame 4 and thus may be fixed. Therefore, when the second guide member 432*b* and the first rail member 431*a* move relative to each other, the main frame 4 can be pivoted about the Y-axis.

A coupling member or block 440 may be installed at the inner side of the extension 420. The coupling member 440 may fix to the second guide member 432*b*. The second guide member 432*b* may be fastened to the coupling member 440 through a fastening or fixing member, such as a bolt. Accordingly, the first and second guide members 431*a* and 432*b*, which may have a different curvature from each other, can be further replaced with a member having a different curvature. The user can select and use a guide member corresponding to the curvature of his or her own hip or pelvis.

Referring to FIGS. 8, 10A and 10B, the pair of bodies 432*b*' and 432*b*" of the second guide member 432*b* may be coupled to each other to form the second guide groove H2. The second rail member 432*a* may have a rail projection 432*a*'. A cross section of the second rail member 432*a* may be formed in a '□'-shape. The rail projection 432*a*' may be projected from an inside of the second rail member 432*a* toward an outside. A cross-section of the second rail member 432*a* with the rail projection 432*a*' may therefore resemble an E-shape. A cross section of the rail projection 432*a*' may be formed in a 'T'-shape. In addition, a cross section of the second guide groove H2 may be formed in a hollow 'T'-shape. The second guide groove H2 may be a hole, or may be a T-shaped groove or recess depending on a coupling of the bodies 432*b*' and 432*b*". The rail projection 432*a*' may be moved along and engage with the second guide groove H2. The size of the 'T-shape' of the rail projection 432*a*' may correspond to a size of the 'T-shape" recess of the second guide groove H2.

When the second waist support 410*b* is worn by the user and the user rotates or twists a lower body about a Z-axis in a transverse plane of motion, the hip joint of the user may be rotated about the Z-axis as the rotation center. The second rail assembly 432 may thus be guided with a movement originating in the user's hip joint and the hip joint supporting position, which may be varied as a lower body of the user is twisted or pivoted about the Z-axis. When the user twists in the transverse plane so that the pelvis of the user is distorted, the main frame 4 may not deviate from the hip of the user or the hip joint supporting position.

Referring to FIGS. 6 to 8, the rotation plate 320 may be installed in the extension 420 to rotate about the X-axis. The rotation plate 320 may include the rotation shaft 321, which may have the X-axis as its rotation center.

Figure 1:
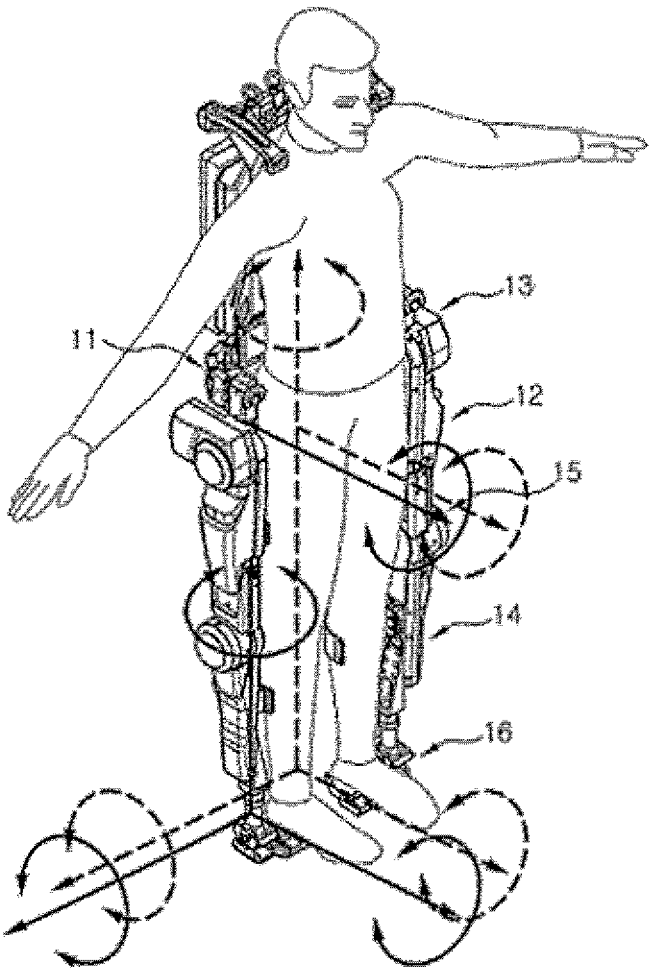
FIG. 1 is a view showing a state in which a user wears a conventional power assisting apparatus.
Figure 2:
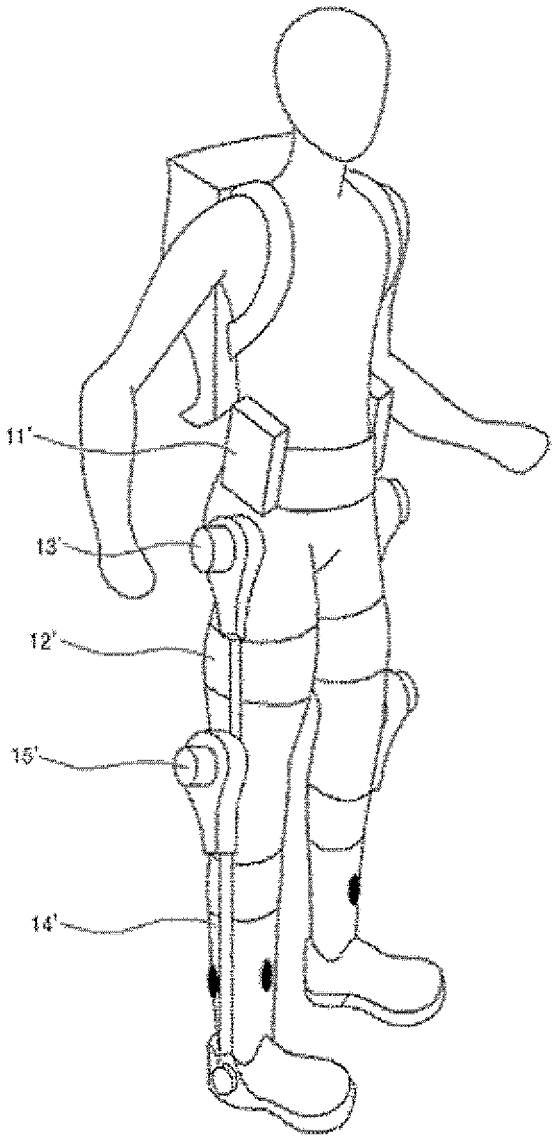
FIG. 2 is a view showing a conventional wearable robot.

When a lower body of the user rotates his or her body forward and rearward, the rotation plate 320 may rotate a portion of the extension 420 that couples to the upper leg frame 6*a* about the X-axis. When the user extends his or her leg forward or backward in the sagittal plane, the hip joint and therefore the rotation plate 320 may rotate about the X-axis. The extension 420 may closely or completely contact the hip or pelvis, e.g., ilium of the user. The rotation plate 320 may provide the first assistive force around axis CL1 corresponding to a hip joint axis of the user (ML1 in FIG. 1). The rotation plate 320 may provide the first assistive force in a direction corresponding to walking, lifting, or bending movement, i.e., forward and backward pivoting movement of the legs about the X-axis in the sagittal plane of motion. During such motion, the main frame 4 may remain secured to the user due to a configuration of the rotation plate 320 and the extension 420.

The user may have a hip joint supporting position on an exterior of his body that corresponds to a position of an internal hip joint. The pair of frames in the main frame 4 may closely contact and support or cover the hip joint supporting position of the user. A section or portion of the main frame 4 above the rotation plate 320 may contact the hip joint supporting position. Therefore, the pair of frames of the main frame 4 can support and/or move in accordance with a movement of the hip joint of the user. The main frame 4 may remain coupled to and supported on the hip of the user at the hip joint supporting position as the user moves in the transverse, sagittal, an frontal planes due to the configuration of the hip matching assembly.

Referring to FIG. 11, when the user's lower body moves (e.g., during walking, bending, or lifting), the position of the hip joint of the user may vary. During walking, bending, or lifting, the hip joint may move up and down, for example, as a user's height changes, and the hip and leg may rotate relative to the hip joint. As previously described, the hip matching assembly 430 may connect the waist support assembly 410 and the pair of frames of the main frames 4. The hip matching assembly 430 may guide a movement of the main frame 4. The main frame 4 may be moved or pivoted around the X-axis, the Y-axis, and/or the Z-axis. When the waist support assembly 410 is worn, the hip matching assembly 430 may allow the main frame 4 to move according to a movement of the hip joint of the user. The hip matching assembly 430 may allow a hip drive axis CL1 of the hip drive 300 to consistently match a hip joint axis ML1 of the user throughout movement, as the hip joint axis ML1 of the user may have a varying position during movement. The hip joint axis ML1 may align with an axis of the user's hip joint, as shown in FIG. 11. As an alternative example, axis ML1 may be a lower pelvic axis ML1 which may align with a greater trochanter of the femur that rotates relative to the ball and socket hip joint. A portion of the main frame 4 may remain positioned at the hip joint supporting position throughout such a movement of the user.

FIG. 11 shows that the hip joint axis ML1 of the user aligns with a ball and socket hip joint axis of the user. In this embodiment, hip drive 300 may be positioned at the hip joint supporting portion on the hip to correspond with an internal position of the hip joint. A hip drive axis CL1 may thus align with the hip joint axis ML1 of the user. However, embodiments disclosed herein are not limited to such a placement of the hip joint axis ML1 and/or the hip drive axis CL1. For example, the hip drive axis CL1 may instead align with a lower pelvis axis ML1 positioned near the lower pelvis below the ball and socket joint of the hip. In this alternative embodiment, the hip drive 300 may be positioned so that the hip drive axis CL1 aligns with such a lower pelvis axis ML1.

The hip matching assembly 430 may vary a position of the extension 420 along three axial directions. Even if the position of the hip joint of the user changes as the user moves his or her legs outward, forward, or in a twist while moving (e.g., walking bending, or lifting), the hip joint supporting position can be stably supported or covered by the pair of frames in the main frame 4.

Figure 12:
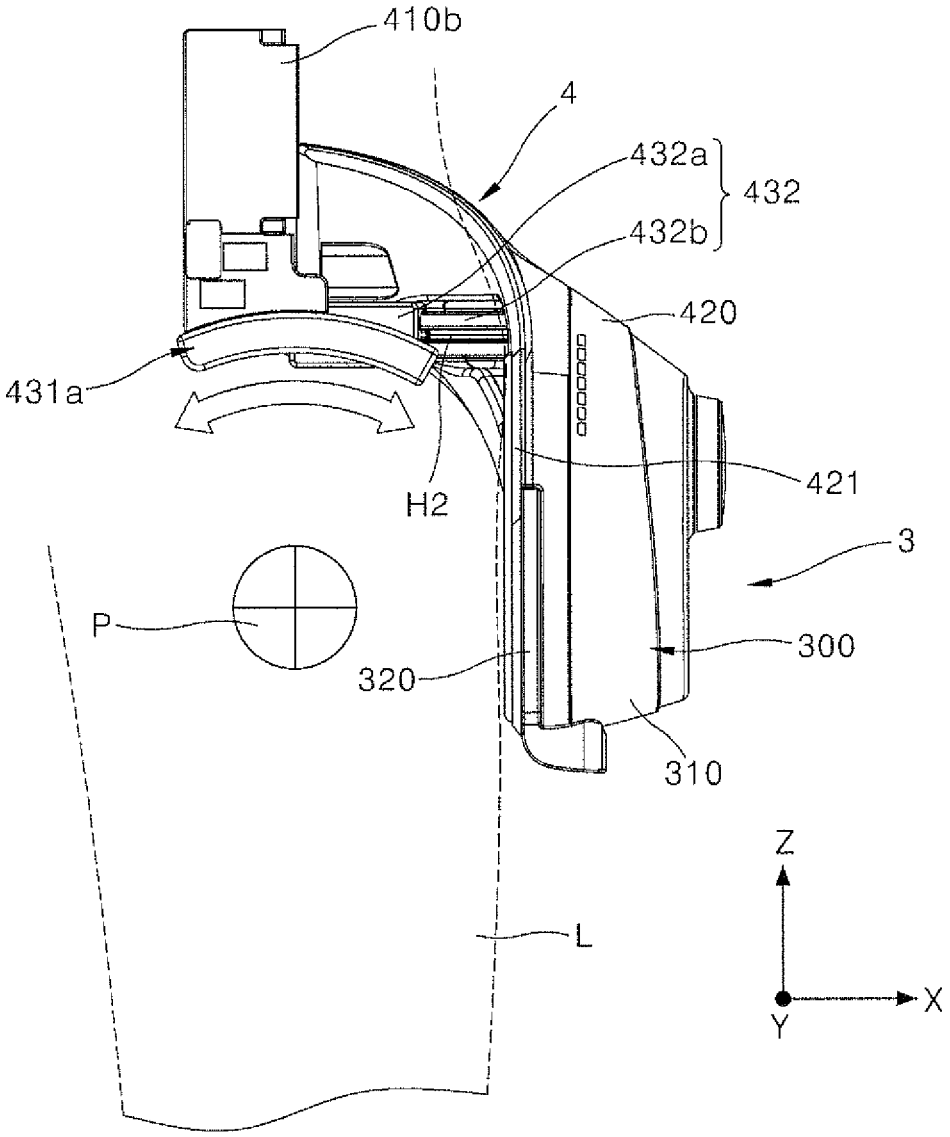
FIG. 12 is a perspective view showing a driving of a first rail portion according to a movement of the user.

As shown in FIGS. 11 and 12, when the user does not move the leg (L) in a standing state, two legs L of the user may be in parallel to each other along the Z-axis or the vertical direction. The distance between the pair of frames of the main frame 4 may be varied so as to closely or completely contact both sides of the hip or pelvis of the user. This adjustment may be made by adjusting the waist support assembly 410 as previously described. Accordingly, the extension 420 provided in each frame of the main frame 4 can closely contact and support both sides of the hip of the user.

Each frame in the main frame 4 can couple to and be secured at an "initial hip position" at the hip joint supporting portion of the user to support both sides of the hip of the user at the hip joint. A hip joint of the user may be located approximately at P.

Figure 13:
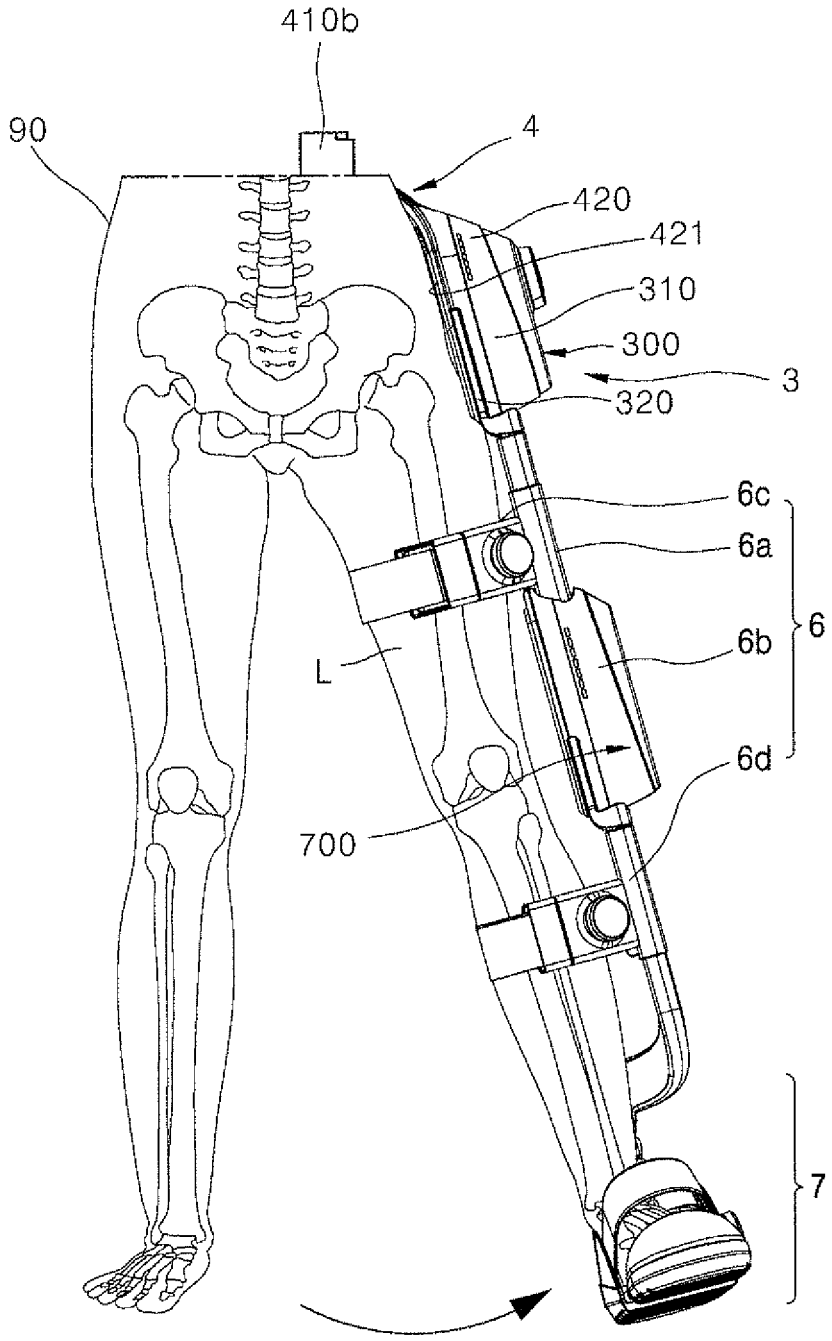
FIG. 13 is a perspective view showing a state in which a lower body of a user is extended to outward away from the body while the user wears an exoskeleton in accordance with embodiment.
Figure 14:
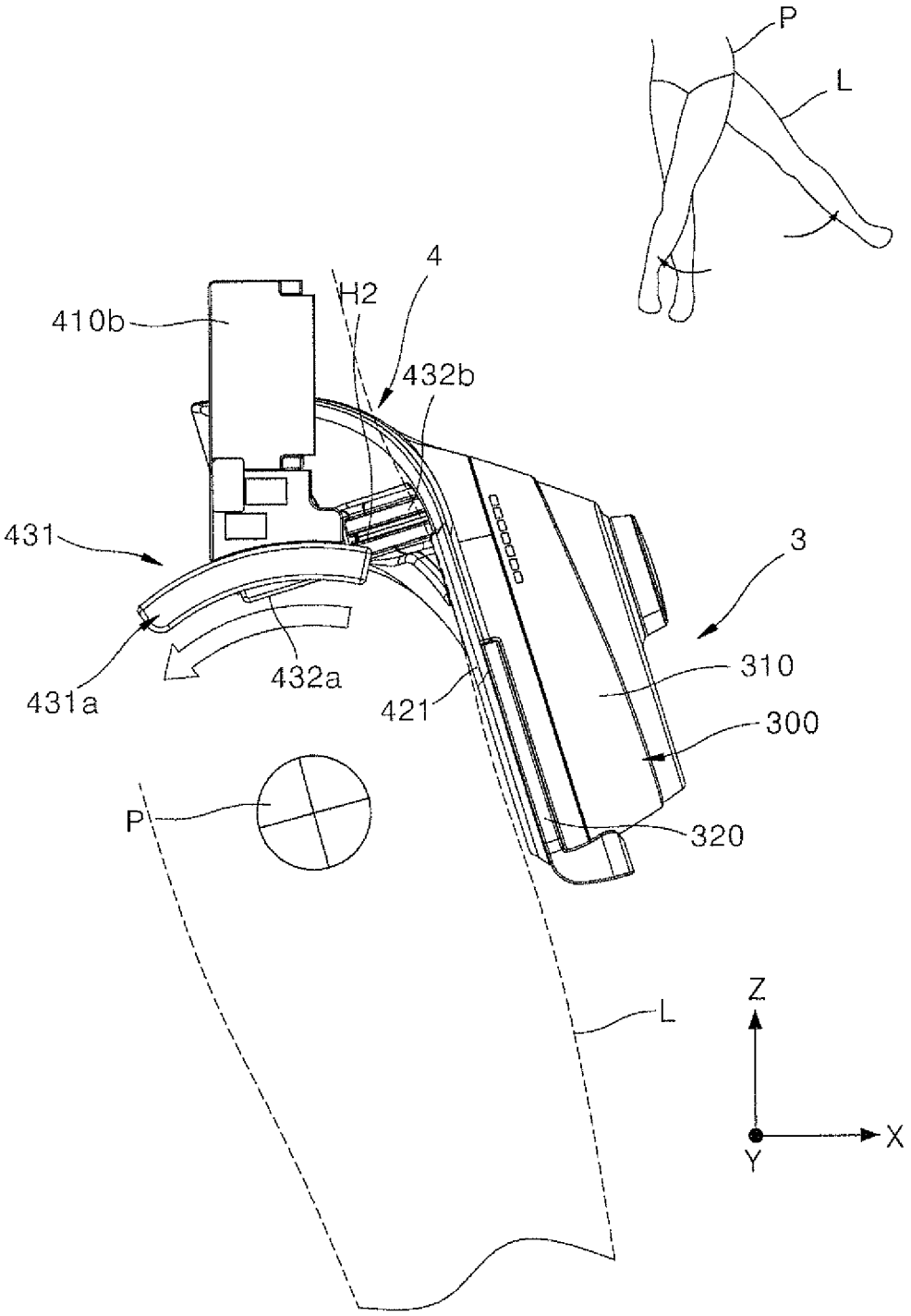
FIG. 14 is a perspective view showing a driving of a first rail portion according to a movement of the user.

As shown in FIGS. 13 and 14, when the user extends his leg or lower body Lout toward the right, a corresponding frame of the main frame 4 can be pivoted by interlocking with a rotation of the lower body and/or leg L. The first guide member 431*a* may move along the first rail member 431*b* of the second waist support 410 via the first guide groove H1. The first rail assembly 431 may thus be moved relative to the second waist support 410. Therefore, the first guide member 431*a*, which may closely or completely contact a rear of the hip or pelvis of the user, may be guided to pivot about the Y axis. Accordingly, the corresponding frame of the main frame 4 can be pivoted to extend rightward or outward.

When the user rotates the lower body L to extend it inward back to the left, a position of the hip relative to the hip joint of the user may be varied. The main frame 4 may be pivoted by interlocking with the rotation of the lower body L of the user. Thus, the "initial hip position" can be maintained such that the main frame 4 is not displaced.

Figure 15:
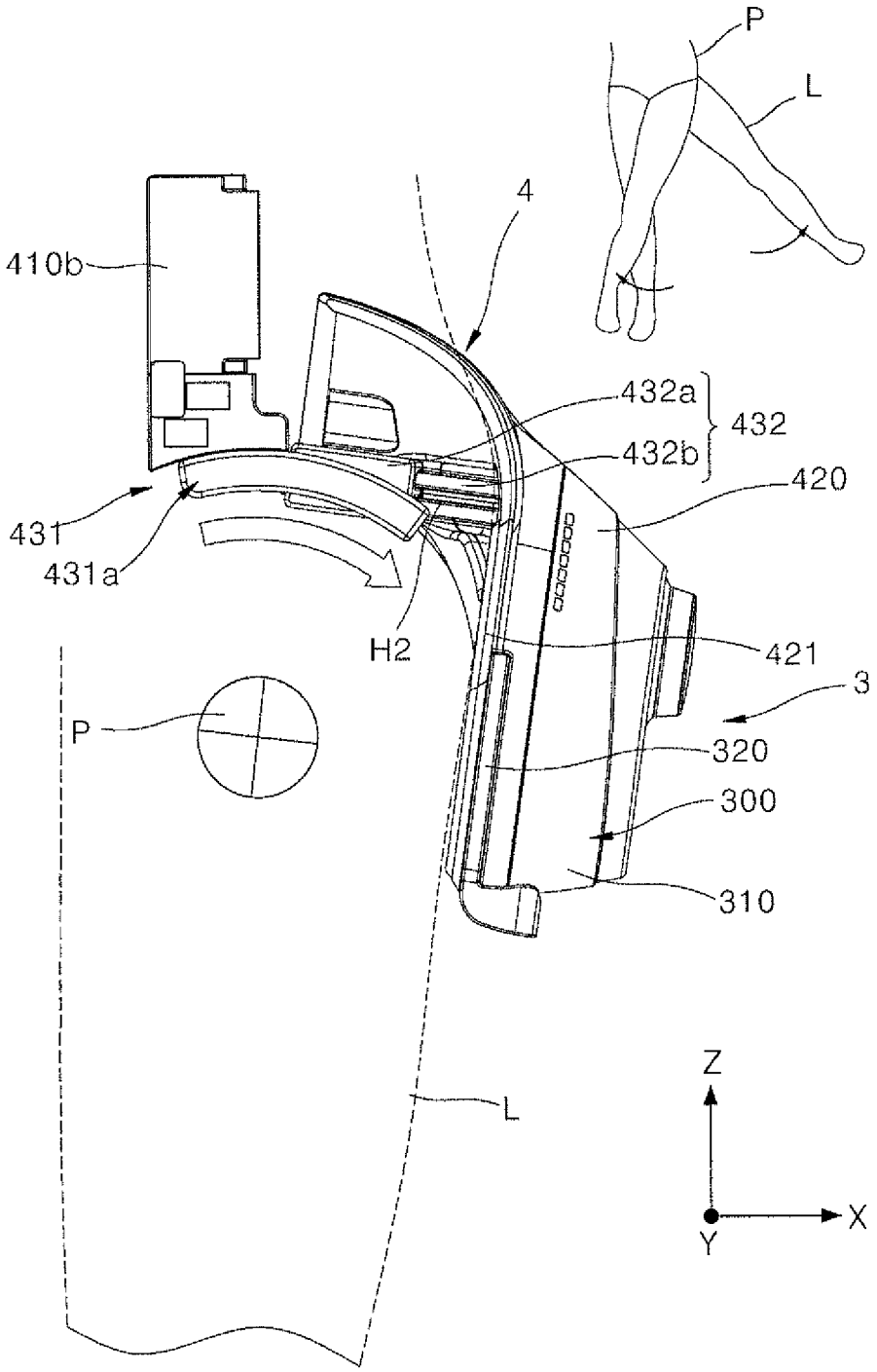
FIG. 15 is a perspective view showing a driving of a second rail portion by a user closing his legs inward while the user wears the exoskeleton.

FIG. 15 is a perspective view showing a driving of the first rail assembly 431 by the user while a user wears the exoskeleton A and closes a lower body or leg L inward. Referring to FIG. 15, when the user rotates his leg L inward (i.e., toward the left), the main frame 4 can be rotated or pivoted by interlocking with a rotation of the leg L.

The second waist support 410*b* may, via the first rail member 431*b*, be moved relative to the first guide member 431*a* via the first guide groove H1. Therefore, the corresponding frame of the main frame 4 that supports a hip joint at P can be rotated, pivoted, or moved inward toward the left side in a motion where the legs L of the user become closed.

When the user rotates the leg L toward the body in the frontal plane, a position of the hip relative to the hip joint of the user may be varied. The main frame 4 may be pivoted about the same axis, the Y-axis, by interlocking with the rotation of the leg L of the user. Therefore, the "initial hip joint position" may be maintained even as the hip moves.

When the user extends or closes the legs of the lower body in a standing posture while wearing the main frame 4, the hip joint supporting position may be varied. The extension 420 may stably support the hip joint of the user by interlocking with the variable hip joint supporting position. Therefore, even if the hip joint supporting position is distorted when the user moves his legs inward and outward, the first assistive force can still aid a user in forward and backward movement without a loss in the first assistive force.

Figure 16:
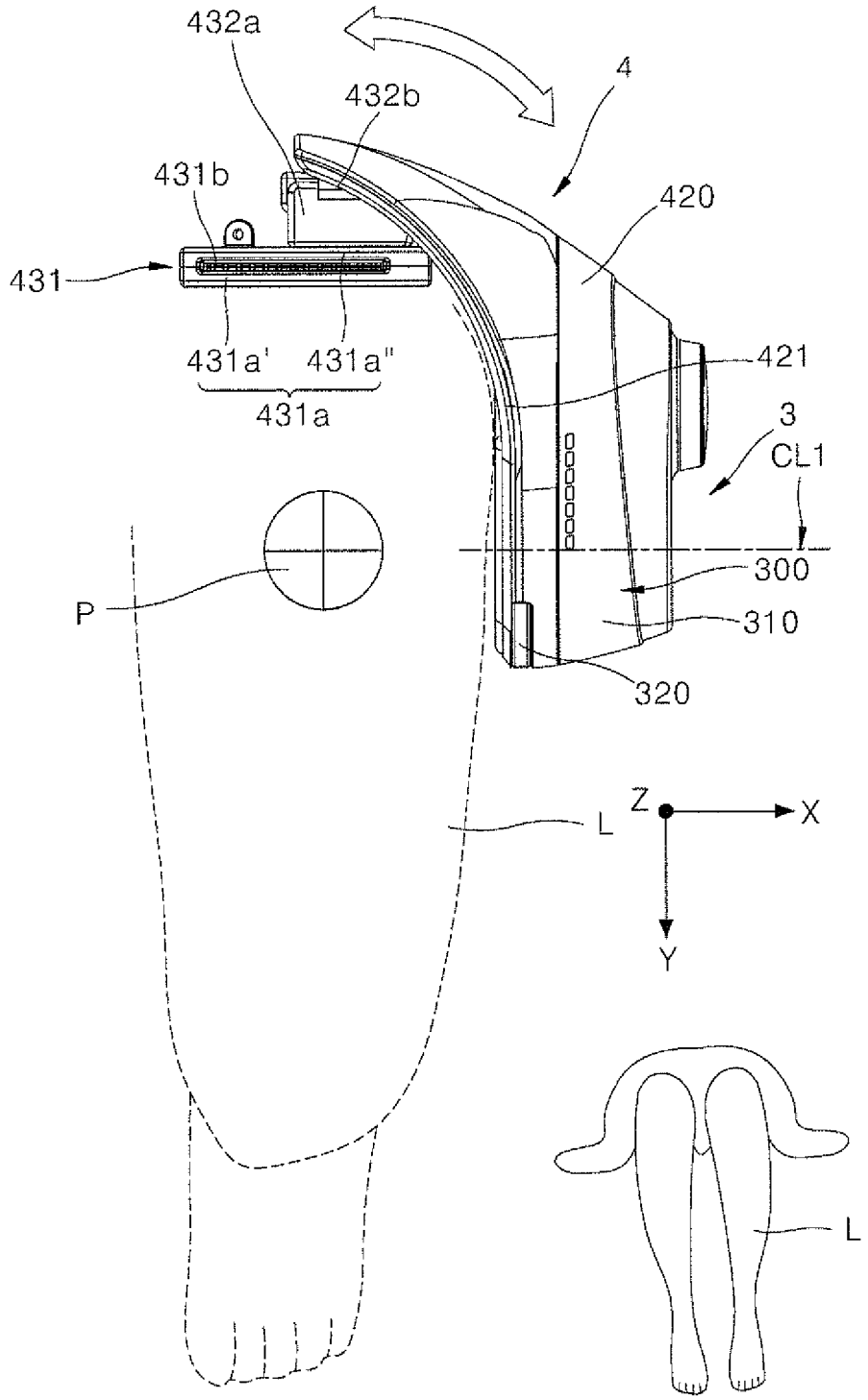
FIG. 16 is a top view showing a hip joint position of the exoskeleton in a sitting state of a user.
Figure 17:
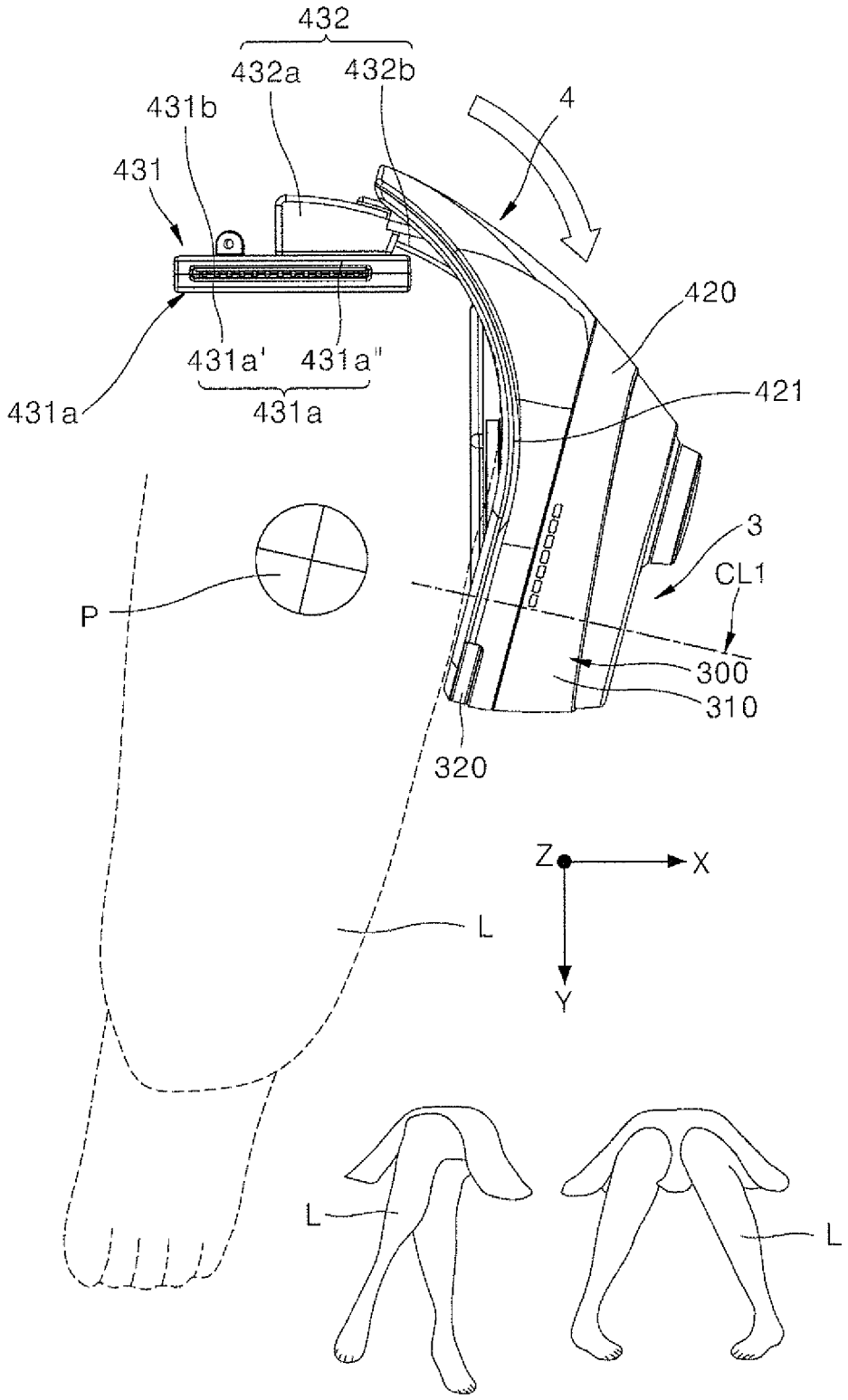
FIG. 17 is a plan view showing a state in which a user closes a lower body inward in a sitting state.

FIGS. 16 and 17 show an example in which a position of the hip or hip joint may be varied depending on an operation or movement of the user where the user extends or closes his legs or lower body L in a sitting state. FIG. 16 may be a plan view showing the position of the hip joint in a sitting state of a user.

As shown in FIG. 16, the leg L of the user may not extend along the forward and rearward directions and the leftward and rightward directions when, for example, the user sits on a chair. Therefore, the first and second rail assemblies 431 and 432 and the rotation portion 320 are not driven by the user. Two lower legs or calves L of the user may be parallel along the vertical direction or the Z-axis. Each extension 420 provided in the main frame 4 can completely contact and thus support each hip of the user. The pair of frames of the main frame 4 can secure an initial hip joint position at the hip joint supporting position.

FIG. 17 is a plan view showing a state in which a lower body may be closed inward while a user sits. FIG. 17 shows an operation of a second rail assembly in accordance with an exemplary embodiment of this application. As shown in FIG. 17, when the user performs closes a leg or a lower body L while the user sits, the extension 420 that supports the hip joint of the user can be rotated or pivoted about the Z-axis.

The second rail member 432*a* may be installed at a rear of the first guide member 431*a*, and may be moved along the second guide groove H2 of the second guide member 432*b* formed at an inner side of the extension 420. When the user sits, an outward movement of the legs may be a movement about the Z-axis instead of the Y-axis. Thus, the first rail assembly 431 may remain in an unmovable state and movement about the Y-axis may be restricted. The extension 420 may be rotated or pivoted about the Z-axis by interlocking with a rotation of the legs or lower body L of the user. Therefore, the initial hip joint position can be maintained.

Figure 18:
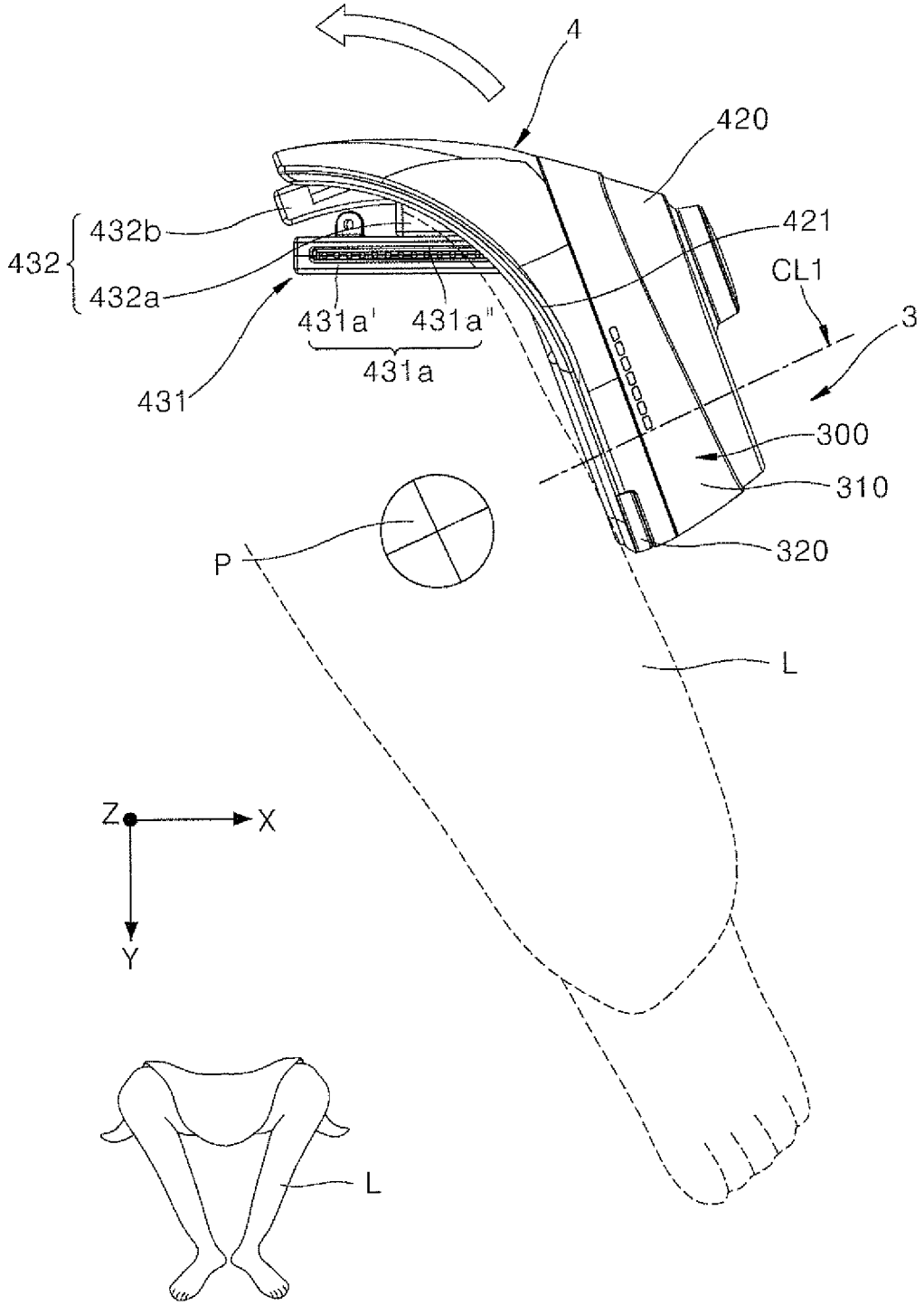
FIG. 18 is a top view showing a state in which a user extends a lower body outward in a sitting state.

FIG. 18 is a top view showing an operation in which the legs extend outward when a user sits. As shown in FIG. 18, when a user extends the legs or the lower body L while sitting, the extension 420 may be rotated or pivoted about the Z-axis.

The second rail member 432*a* installed behind the first guide member 431*a* may be moved along the second guide groove H2 of the second guide member 432*b* formed at an inner side of the extension 420. The second guide member 432*b* installed at an inner side of the main frame 4 may be movable relative to the second rail member 432*a*.

The second rail member 432*a* may be guided in a direction opposite a rotation direction in FIG. 17. When the user extends or opens the legs or the lower body L in a sitting state, the position of the hip or hip joint of the user may change or vary. The extension 420 may be interlocked with a rotation of the lower body L of the user. Thus, the extension 420 may be rotated or pivoted according to a movement of the user. The extension 420 may match a movement of the user. A rotation or pivot center of the extension 420 may be a Z-axis. Therefore, the initial hip joint position can be maintained.

The main frame 4 may stably support the hips at the hip joints of the user in a seated or sitting stated by interlocking with the varied hip joint supporting position of the user. Even if the hip joint supporting position may vary while the user moves the lower body while sitting or while in a seated state, the first assistive force can be correctly and efficiently applied and delivered to the upper leg frame 6*a* to, for example, assist the user in standing.

Referring to FIGS. 16-18, the hip drive axis CL1 may align with an axis of the user positioned at or near a center of the hip joint P. FIGS. 16-18 exemplify an alignment where the hip drive axis CL1 aligns with the center of the hip joint P. Even though it may appear in the various views of FIGS. 16-18 that the hip drive axis CL1 may not appear aligned with the center of the hip joint P based on angle viewed at the hip area, the hip drive axis CL1 is in fact aligned with the center of the hip joint P. Nevertheless, embodiments disclosed herein are not limited to the exemplified alignment of CL1 shown in FIG. 16. In alternative embodiments, the hip drive axis CL1 may align with an axis positioned slightly below or above a center of the hip joint P.

Figure 19:
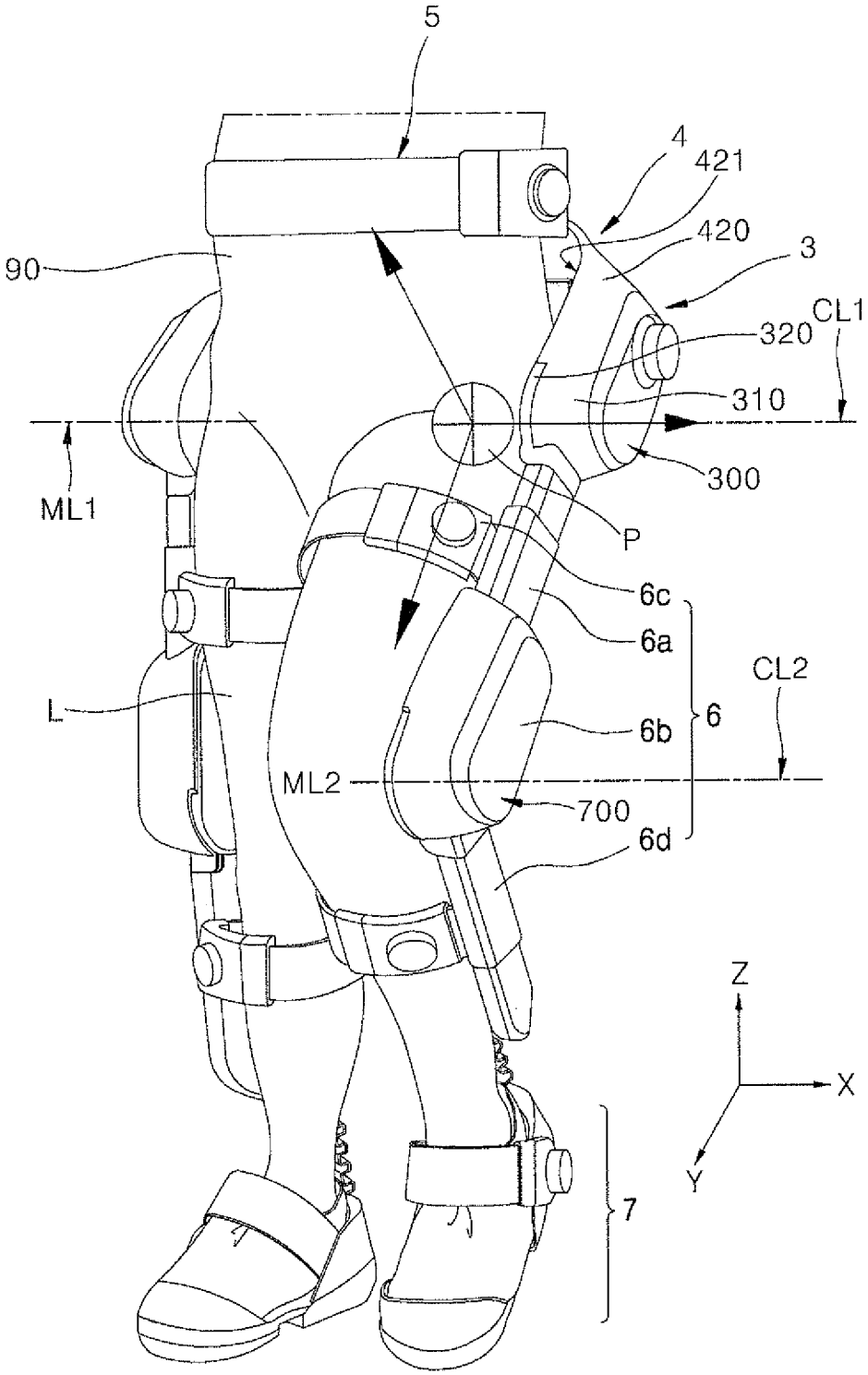
FIG. 19 is a perspective view showing a state in which a user stands up and bends a lower body.
Figure 20:
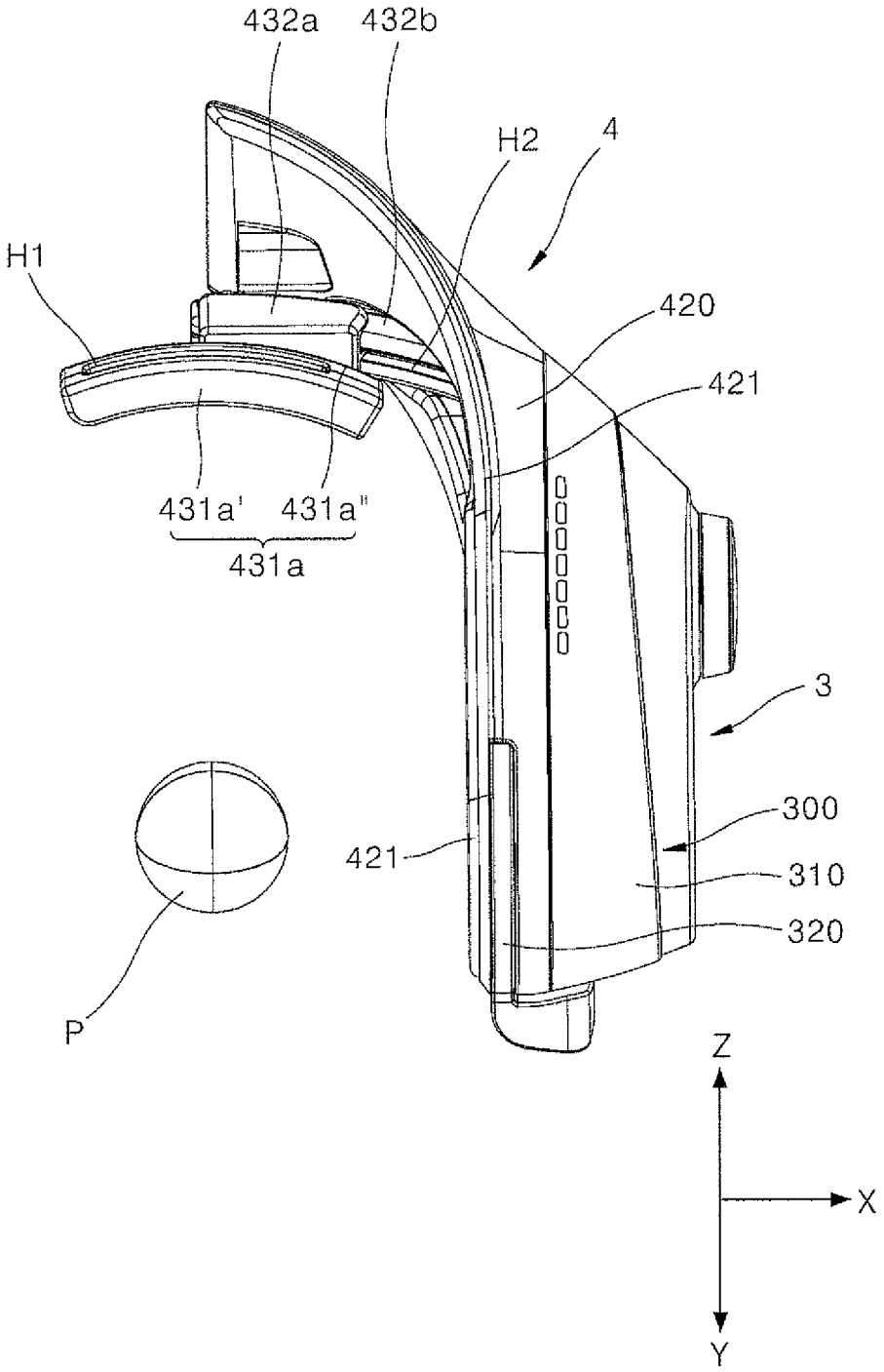
FIG. 20 is a perspective view showing a driving of a second rail portion by a moment of the user in FIG. 19.

FIG. 19 is a perspective view showing a state in which the user stands up and bends his legs. FIG. 20 is a perspective view showing a driving of a second rail assembly by the user according to the movement of FIG. 19. As shown in FIG. 19, when both sides of the hip are closely secured to the main frame 4, and when the user bends any one of the legs L forward or backward about the X-axis in only the sagittal plane, the first and second rail assemblies 431 and 432 may not be driven by the user, as shown in FIG. 19.

Figure 21:
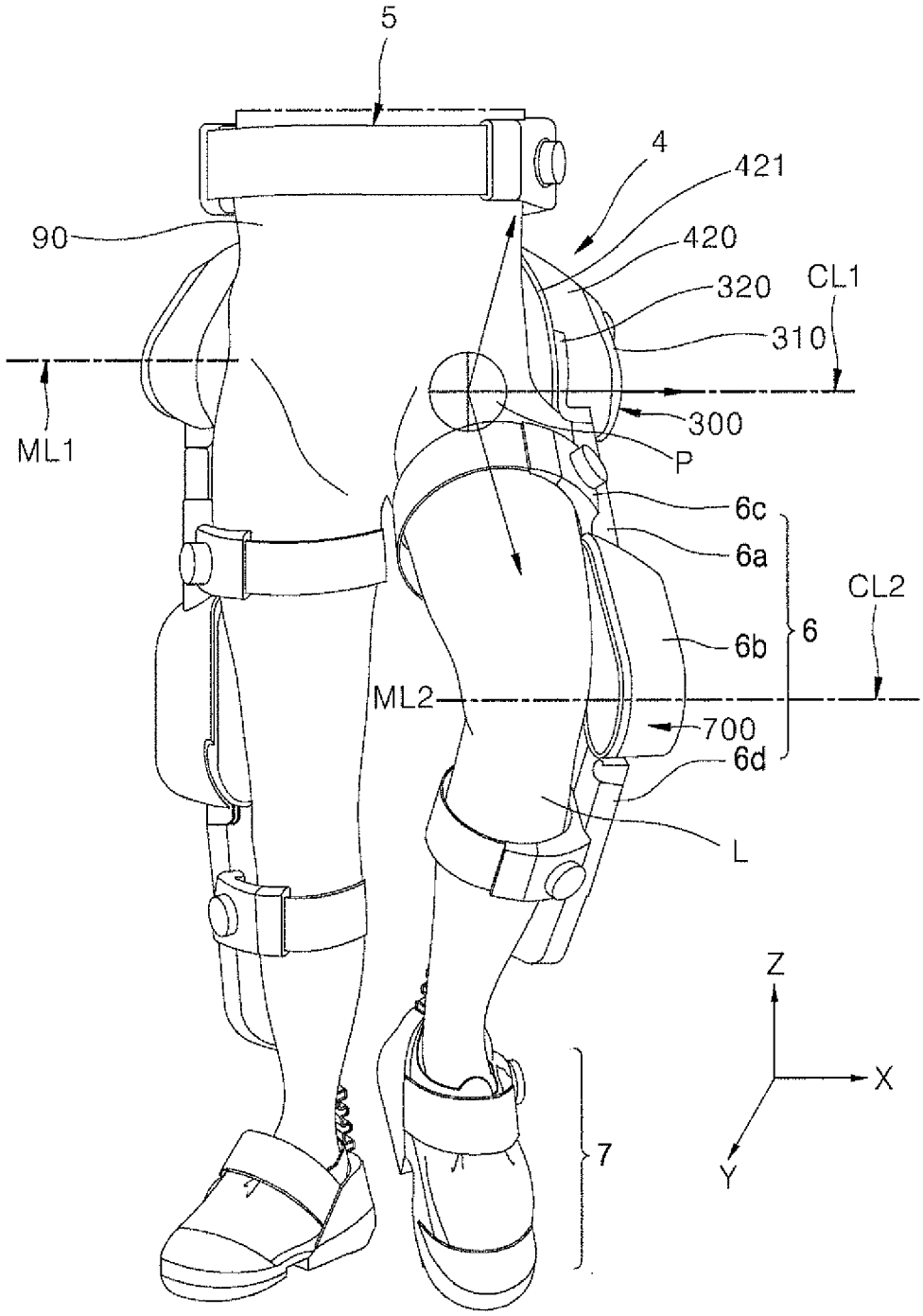
FIG. 21 is a perspective view showing a state in which a user stands up and bends a lower body, and extends it outward.
Figure 22:
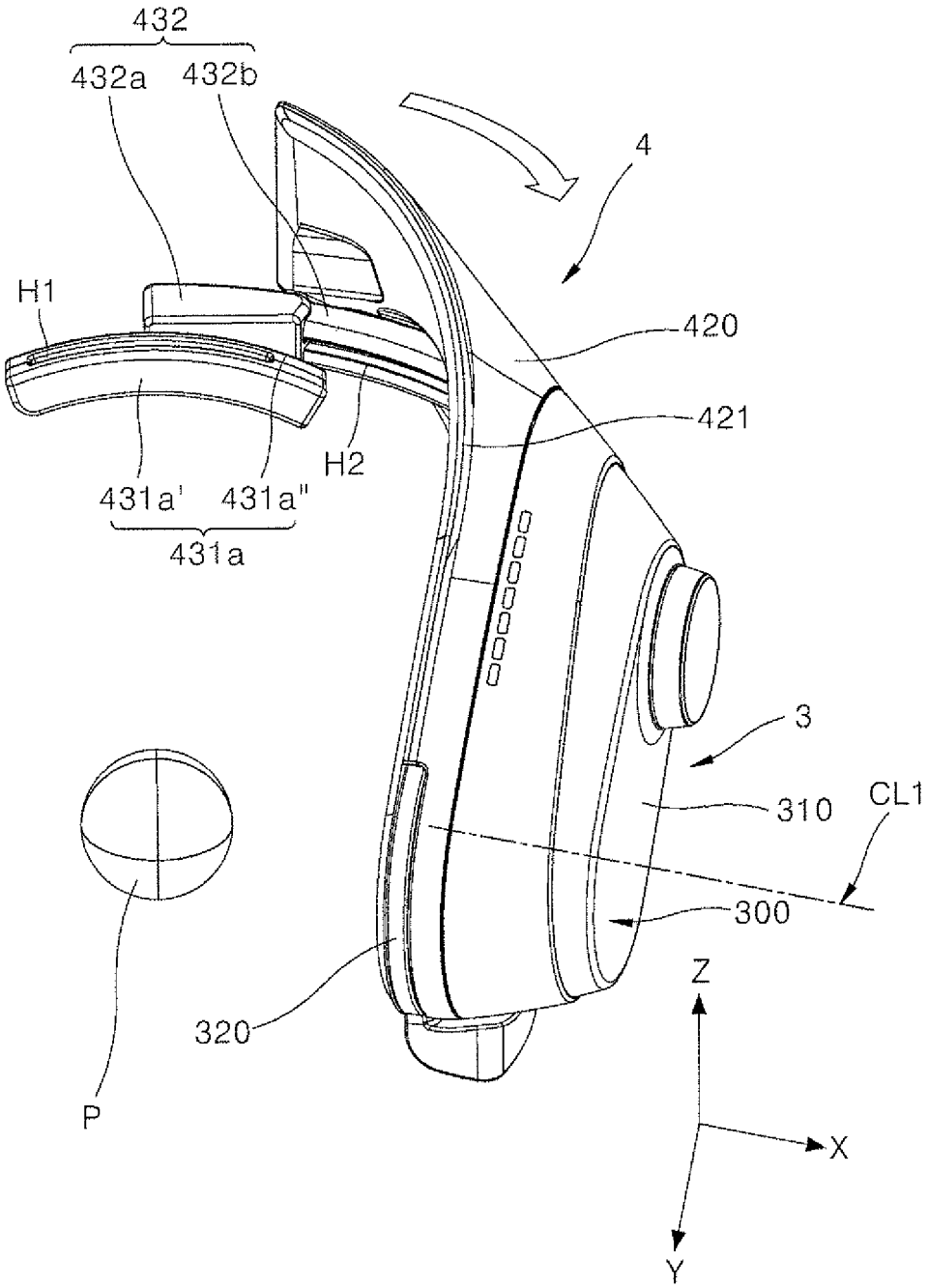
FIG. 22 is a perspective view showing a driving of a second rail portion by a user who stands up and bends a lower body, and extends it to an outside.

FIG. 21 is a perspective view showing a state in which a user stands up and bends his leg L and extends it outward. FIG. 22 is a perspective view showing a driving of the second rail assembly 432 by the user when the user moves according to FIG. 21. In the above-described state, as in FIG. 21, the second rail member 432*a* (installed behind the first guide member 431*a*) may be moved along the second guide groove H2 of the second guide member 432*b* (formed at an interior of the extension 420) when the user extends the leg L outward. The first guide member 431*a* and the second rail member 432*a* move relatively to each other. Accordingly, as shown in FIG. 22, the corresponding extension 420 can be rotated or pivoted about the Z-axis.

The user may extend or close the legs L when also rotating the legs forward during walking, bending, or lifting, for example. A movement of the extension 420 may correspond to a movement or rotation of the legs L. The main frame 4 may maintain a predetermined hip joint supporting position regardless of a movement of the legs L of the user. Therefore, even if the user moves to various postures, the first assistive force may be easily delivered and correctly applied to assist the user so that the user may bend his legs.

The hip matching assembly 430 may match a hip joint axis (ML1) (see FIG. 11) of the user with a hip drive axis (CL1) of the exoskeleton A. A portion of the main frame 4 (e.g., at the hip matching assembly 430 or at the rotation plate 320) may be provided at the hip joint supporting position. However, embodiments are not limited to the exemplified positions of axes ML1 and CL1. In an alternative embodiment, the hip drive axis CL1 may align with a lower pelvic axis ML1.

Even if the user moves the hip joint while wearing the exoskeleton A, the first assistive force can be stably and efficiently provided to assist a movement of or originating from the hip joint of the user. Even if a position of both hip joints of the user may be varied throughout movement, the main frame 4 may be stably provided on the user. The hip matching assembly 430 may ensure that the first assistive force is efficiently and stably delivered to the user when the user changes to various postures and his hip joint moves.

Figure 23:
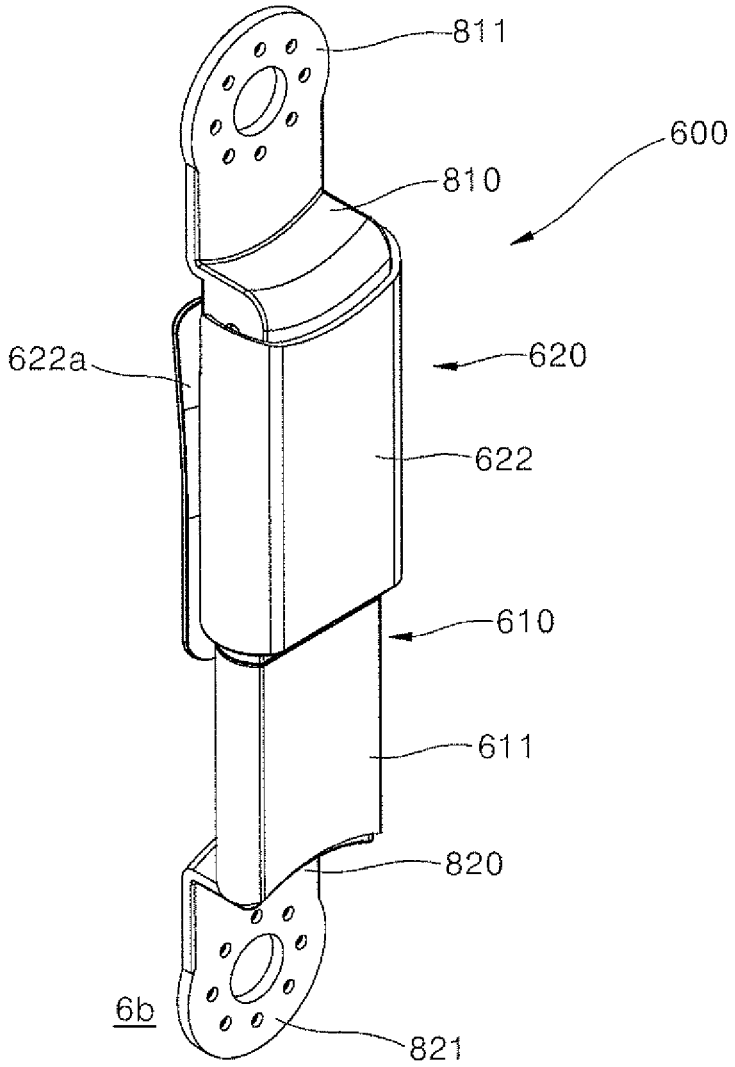
FIG. 23 is a perspective view showing a configuration of an upper leg support in accordance with an embodiment.
Figure 24:
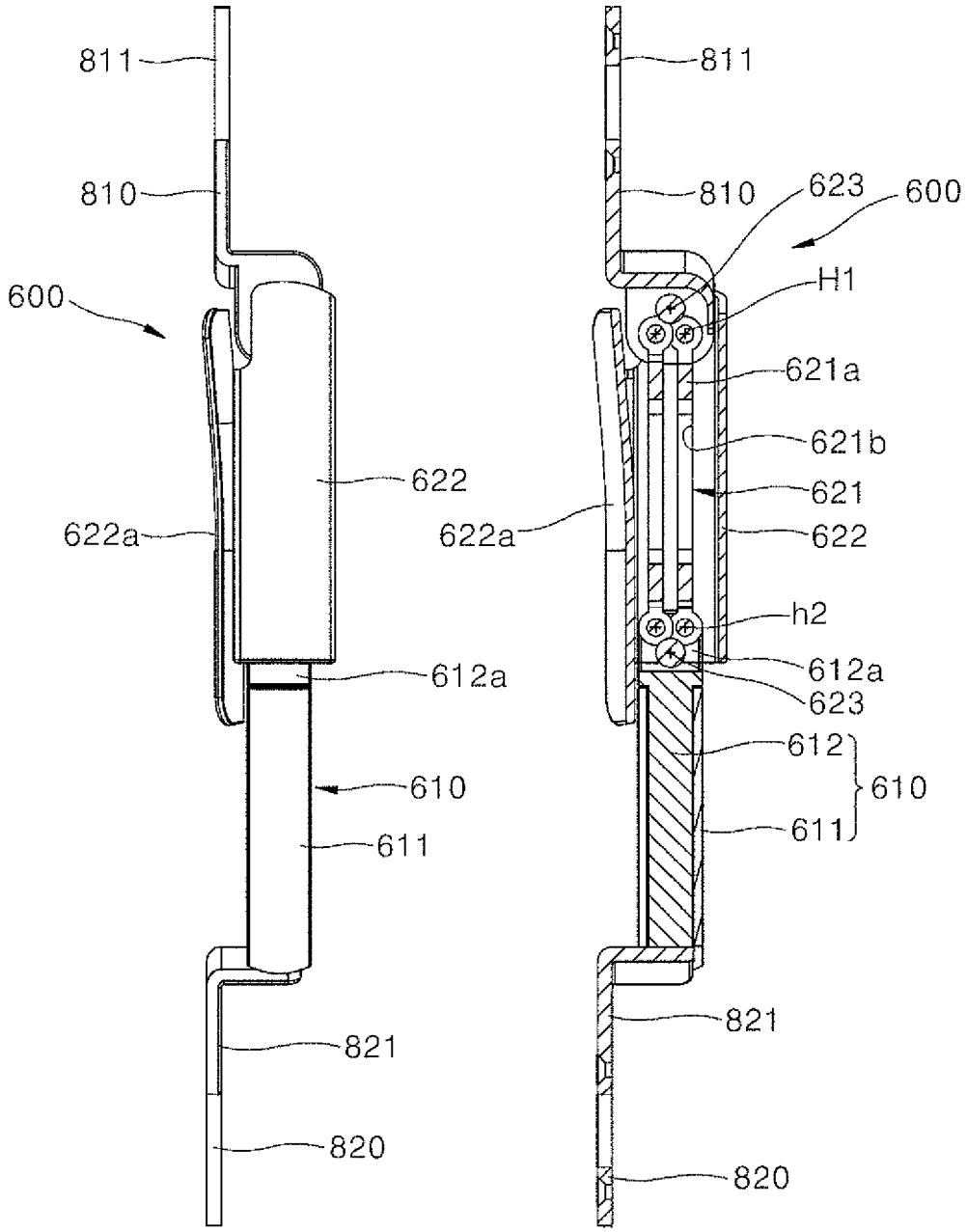
FIG. 24 is a view showing a state before a rotation of an upper leg support in accordance with an embodiment.

FIG. 23 is an exploded perspective view showing a configuration of a joint supporting unit or a joint support included in an exoskeleton A. FIG. 24 is a coupling perspective view showing a configuration of a joint support for an exoskeleton A in accordance with embodiment.

The upper leg frame 6*a* may be a portion of the leg assembly 6 that corresponds to a skeleton, i.e., femur of the user. The upper leg frame 6*a* may include a joint support or upper leg support. Referring to FIGS. 21, 23, and 24, the exoskeleton A may include a hip drive 300, a knee drive 700, and the connection frame 600.

Referring to FIG. 23 and FIG. 6, the hip drive 300 may provide the first assistive force to a hip joint of a user. The hip drive 300 may include or couple to a first supporting bracket or a first bracket 810. A first connecting or joint member 811 may be formed at an upper end of the first bracket 810. The first joint member 811 may be rotatably connected to the hip drive 300. The hip drive 300 may rotate the first joint member 811 to rotate the upper leg frame 6*a* about the actuated hip joint 3.

An upper end of an inclination portion 620 may be connected to a lower end of the first bracket 810 via a hinge method. For example, the inclination portion 620 may connect to the first bracket 810 via two hinges such that it may rotate toward and away from the first bracket 810 in the frontal plane.

Referring back to FIG. 21, the knee drive 700 may provide the second assistive force to a knee joint of a user. The knee drive 700 may couple to a second supporting bracket or a second bracket 820 to rotate the lower leg frame 6*d*. A lower end of the second bracket 820, which may include a second connecting or joint member 821, may be rotatably connected to the knee drive 700. The second joint member 821 may be formed at the lower end of the second supporting bracket 820. A lower end of a length adjusting portion or length adjustment portion 610 may be connected to an upper end of the second supporting bracket 820.

The upper leg support 600 may connect the hip drive 300 and the knee drive 700. The upper leg support 600 of the upper leg frame 6*a* can be adjusted in length upward and downward at the length adjustment portion 610. Further, the upper leg support 600 may be adjustable in inclination to the left or right at the inclination portion 620.

The length adjustment portion 610 may include an adjustment body or outer frame 611. A lower end of the outer frame 611 may be connected to an upper end of the second bracket 820. Referring to FIG. 24, view (a), an inner frame or shaft 612, which may be projected upward and downward, may be provided in the outer frame 611. The inner frame 612 may also be referred to as an ascending and descending member. A connection end 612*a* may be formed at an upper end of the inner frame 612. The inner frame 612 may be projected from the outer frame 611 so as to ascend and descend a length of the length adjustment portion 610, and thus the upper leg frame 6*a* may be adjusted along the vertical direction to correspond to a length of a thigh of the user. An adjustment will be described in detail later with reference to FIG. 26.

Referring to FIG. 24, view (b), the inclination portion 620 may include a link member or link frame 621. A first hinge end h1 may be formed at an upper end of the link frame 621. A second hinge end h2 may be formed at a lower end of the link frame 621. The first hinge end h1 may be connected to the lower end of the first bracket 810 via a hinge method. The second hinge end h2 may be connected to the upper end of the second bracket 820 by a hinge method. The hinge methods will be described in detail later.

Therefore, the upper and lower ends of the link frame 621 may form hinge structures. The link frame 621 may be pivoted along the left and right sides, or away and toward the user. Accordingly, an inclination of the link frame 621 can be adjusted to the left or right. The left or right side may be a direction determining how close the exoskeleton A may contact the user. The link frame 621 may be moved toward the user (i.e., inward toward the left) so that it can closely or completely contact the user, or may be moved away from the user (i.e., outward toward the right) so that the link frame 621 is spaced apart from the thigh side of the user.

The link frame 621 may include a link member body or link body 621*a*. The link body 621*a* may have the first and second hinge ends h1 and h2. The link body 621*a* may be formed in a plate shape. A cut hole or opening 621*b* of a predetermined size may be formed in the link body 621*a*. Accordingly, the weight of the link body 621*a* can have a predetermined weight or less. That is, the cut hole 621*b* may reduce the weight of the link body 621, and may not completely separate the link body 621*a* into pieces.

The first hinge end h1 may be formed as a pair of first hinge ends on front and rear sides of an upper end of the link body 621*a*. A first shaft 623 may be installed between the pair of first hinge ends h1, which may have holes. The second hinge end h2 may be formed as a pair of second hinge ends on front and rear sides of a lower end of the link body 621*a*. A second shaft 623 may be provided between the pair of second hinge ends h2, which may have a pair of holes.

The first and second shafts 623 may loosely fasten first and second hinge ends h1 and h2. A loose fastening may allow the user to flexibly move or her thigh inward and outward. Alternatively, the first and second shafts 623 may be tightened to stably fix an inclination of the inclination portion 620 to conform to an inclination of the thigh of the user. The first and second shafts 623 may be tightened via a screw method, for example. There may be multiple hinge holes and shafts of each hinge end h1 and h2. Thus, inclination portion 620 may pivot even if the shafts or link frame 621 breaks.

As shown in FIG. 24, there may be two link frames 621, where a first link frame 621 connects to a first hinge shaft and hinge hole of the first hinge end h1 and a second link frame 621 connects to a second hinge shaft and hinge hole of the first hinge end h1. The first and second hinge shafts may be smaller than the first and second shafts 623. Accordingly, even if any one of the link frames 621 is broken, the inclination portion may still rotate or pivot toward and away from the user. The link frame 621 may be surrounded by a cover 622. The pair of link frames 621 may be arranged inside the cover 622 to be protected from an outside.

A sealing or contact plate 622*a* may be installed on an inner side of the inclination portion 620 to connect to the cover 622. The contact plate 622*a* may contact a thigh of a user. The inclination portion 620 may be pivoted by a predetermined angle so as to closely or completely contact the thigh of the user at the contact plate 622*a*. Accordingly, the inclination portion 620 may have a predetermined inclination customized to fit with an inclination of the thigh.

Figure 25:
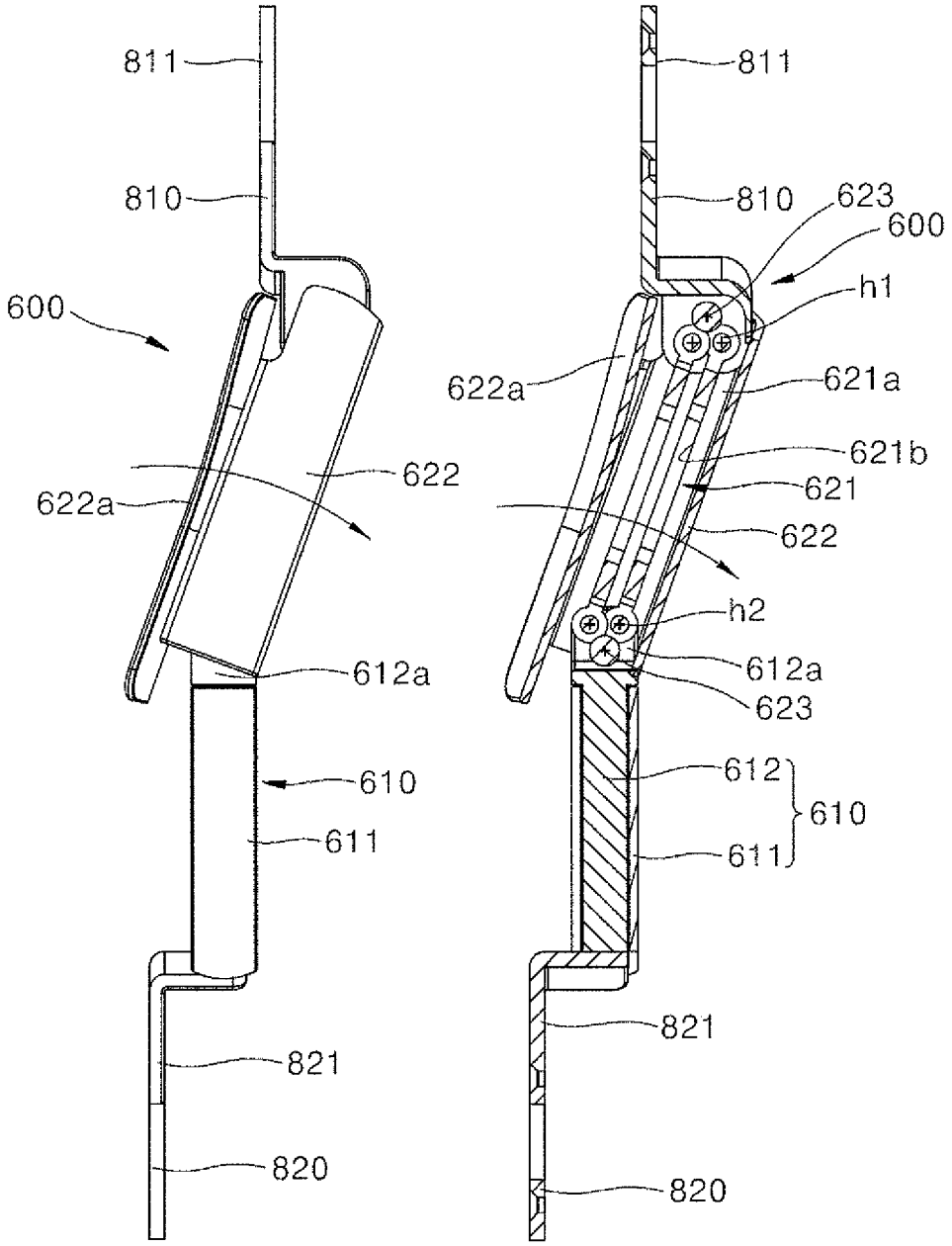
FIG. 25 is a view showing a state after a rotation of an upper leg support in accordance with an embodiment.

FIG. 24 is a view showing a state before a pivot or inclination of the upper leg support 600 in accordance with an embodiment FIG. 25 is a view showing a state after a pivot or inclination of the upper leg support 600 in accordance with an embodiment.

As shown in FIG. 24, the link frame 621 may be a straight shaft or plate along the vertical or z-axis direction before pivoting or having an inclination. As shown in FIG. 25, the first hinge end H1 may be connected to the first bracket 810 via a hinge method. The second hinge end H2 may be connected to the connection end 612*a* formed at an upper end of an inner frame 612 via a hinge method. Accordingly, the link frame 621 may have a predetermined angle so as to closely or completely contact a thigh of the user, and can be rotated. The link frame 621 may be rotated between an upper end of the inner frame 612 and the second bracket 820 about the first and second hinge ends h1 and h2 as a rotation center.

Figure 26:
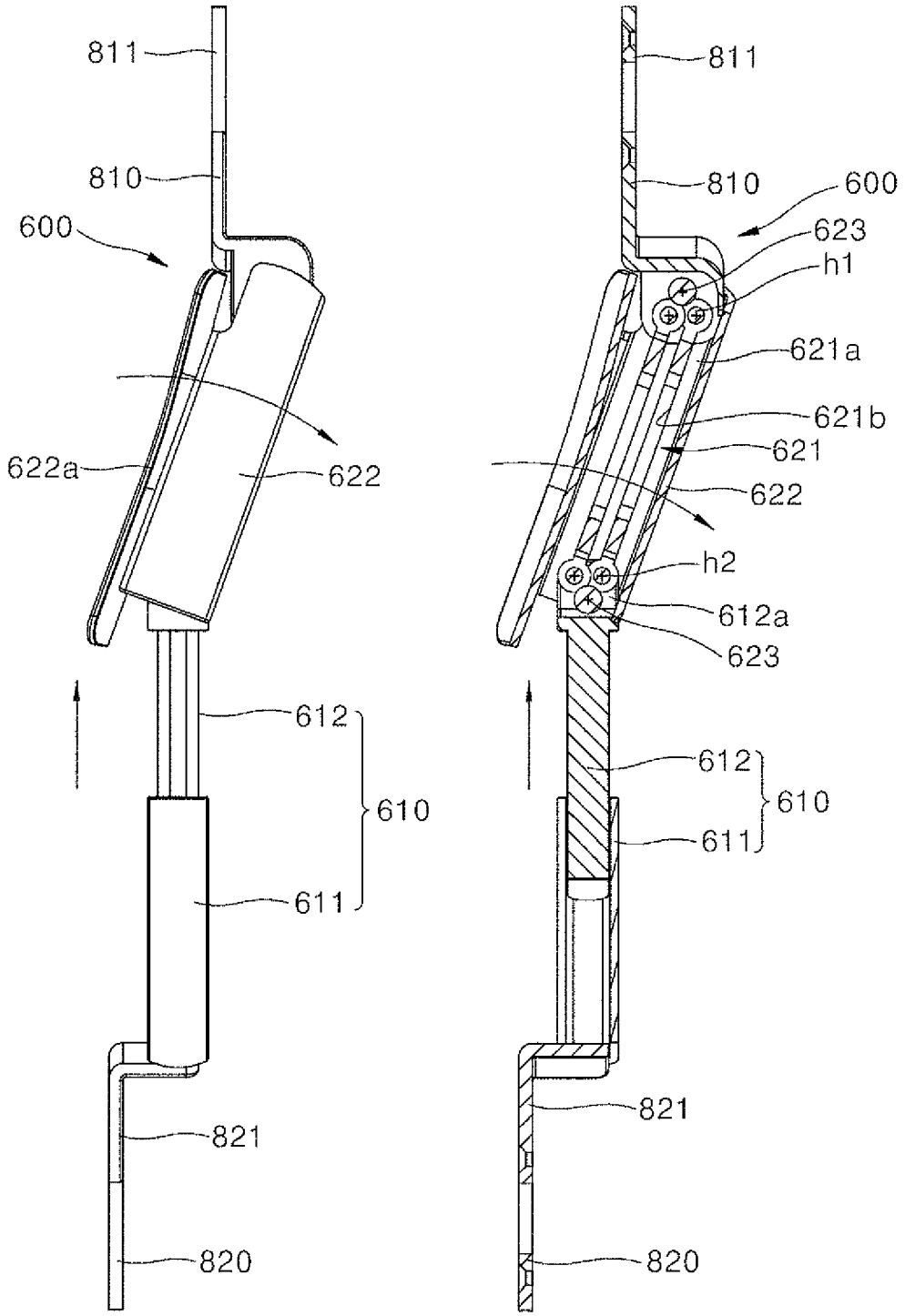
FIG. 26 is a view showing a state in which an upper leg support is adjusted upward in length in accordance with an embodiment.

FIG. 26 is a view showing a state in which the upper leg support 600 may be adjusted in length upward. Referring to FIG. 26, while the inclination portion 620 is inclined at a predetermined angle, the length adjustment portion 610 may project the inclination portion 620 upward. The inner frame 612 may be projected along an upward direction from an outer frame 611. The adjustment of the length of the upper leg frame may be driven by a drive or driving means such as a linear actuator (e.g., electric, hydraulic, or pneumatic). The link frame 621 connected to an upper end of the inner frame 612 by a hinge method can be ascended and descended to a predetermined position upward and provided thereon. Therefore, the upper leg support 600 can be adjusted to correspond to the length of a thigh or an upper leg of a user, and the inclination portion 610 may closely or completely contact a thigh of a user.

The upper leg support 600 may maintain a distance between a knee drive 700 and a hip drive 300. The inner frame 612 may be projected upward from the outer frame 611 while also being inclined at the predetermined angle. Thus, the length of the upper leg support 600 may be varied, and the hip drive axis (CL1) of the hip drive 300 can match the hip joint axis (ML1) of the user.

The cover 622 that surrounds the link frame 621 through the rotation may be inclined. The contact plate 622*a* installed at the inner side of the inclination portion 620 can easily contact an outer circumference of an inclined thigh. Therefore, the upper leg support 600 may closely or completely contact a thigh of a user.

The lower leg frame 6*d* may include a similar structure having similar inclination portions and length adjustment portions so that a length of the lower leg frame 6*d* may also be adjusted. Accordingly, the knee joint axis (CL2) of the knee drive 700 may match or correspond to the knee joint center axis (ML2) of the user.

The hip drive axis (CL1) of the hip drive 300 shown in FIG. 11 may match the hip joint axis (ML1) of the user via adjustment of the length and inclination of the upper leg frame 6*a*. The hip drive axis (CL2) of the knee drive 700 shown in FIG. 11 can also match the knee joint center axis (ML2) of the user via adjustment of the length and inclination of the lower leg frame 6*d*. A loss of the first and second assistive forces provided to the actuated hip joint 3 and the actuated joint 6*b* to assist a motion of the hip and knee joints of the user can be effectively reduced. When the hip matching portion 430 and the inclination portion 620 completely contact the user, less force by the hip and knee drives 300 and 700 is needed to assist the user.

Embodiments disclosed herein may include an upper leg support, supporting unit or connection frame to closely contact a thigh of the user. Accordingly, a driving portion provided at an upper portion and a lower portion of the upper leg support (that is, a hip drive provided at an upper portion and a knee drive provided at a lower portion) may be correctly placed to assist a motion of a joint (such as the hip joint or the knee joint of the user) requiring an assistive force. Accordingly, each driving portion may correctly deliver the assistive force to the joint of the user. A part of the assistive force may not be lost or misapplied when being delivered to the corresponding joint of the user.

Since various substitutions, changes, and modifications can be made within the scope that does not deviate from the technical idea of the present disclosure for those skilled in the art to which this application pertains, embodiments disclosed herein are not limited by the above-mentioned embodiments and the accompanying drawings.

Embodiments disclosed herein may provide a wearable assistive device such as a wearable robot, e.g., exoskeleton, including a main frame unit or main frame that may freely move according to a movement of a hip joint of a user. The main frame may have a predetermined curvature and may be in close contact with the hip joint of the user. The main frame may be worn on a body of the user.

Embodiments disclosed herein may provide a wearable assistive device or exoskeleton that stably provides an assistive force by matching a hip joint driving portion or hip drive with an axis line of a hip joint of the user. The hip drive may stably provide an assistive force to the hip joint of a moving user. The hip drive may provide an accurate assistive force to a body portion of the user. Alternatively, the hip drive may not exactly match the hip joint axis of the user, and may be provided below or above the hip joint axis line.

An embodiment of the exoskeleton A may be matched with a lower pelvic axis of the user, which may be moved depending on a walking, bending, or lifting motion. An alternative embodiment of the exoskeleton A may be matched with a hip joint center axis of a user, which may be moved or driven during walking, bending, or lifting.

Embodiments disclosed herein may provide a wearable assistive device or exoskeleton including a supporting unit or leg support capable of correctly or efficiently providing a corresponding assistive force to assist a movement originating in the hip joint or knee joint of a user. The assistive force may be provided at a position of or corresponding to a hip joint and a knee joint of a user. The leg support may move and closely contact a position of a driving unit or drive to generate the assistive force to the user, who may require an assistive force. The leg support may prevent the assistive force delivered to a corresponding leg or body portion from being lost or misapplied.

Embodiments disclosed herein are not limited to the above-mentioned objects, and the other objects and the advantages of the present disclosure which are not mentioned can be understood by the following description, and more clearly understood by the embodiments of this application. It will be also readily seen that the objects and the advantages of this application may be realized by means indicated in the patent claims and a combination thereof.

The wearable assistive device or exoskeleton may include the main frame to support, secure, and/or cover the hip joint of the user. The main frame may have a predetermined curvature so as to closely contact the hip joint of the user. The first assistive force may be correctly delivered at or to the hip joint of the user while the main frame covers the hip joint of the user.

Embodiments disclosed herein may provide a hip joint matching unit or hip matching assembly. In the hip matching assembly, a hip joint center axis of the user, which is varied as the hip joint of the user is moved, may match with or correspond to an axis of a position supporting the hip joint. When the user assumes various postures while the user wears the wearable assistive device, the assistive force may be stably provided at or to a moving hip joint via the hip joint matching assembly. Alternatively, the assistive force may be provided above or below a hip joint of the user. A part of the assistive force may not be lost while it is delivered to the moving hip joint by using the hip joint matching assembly.

Embodiments disclosed herein may provide a supporting unit or upper leg support that may closely contact a thigh of a user through a length adjustment and an inclination adjustment. For this purpose, each driving portion or drive may be correctly provided at a joint position of the user which requires an assistive force by using the upper leg support. Further, by using the upper leg support, an assistive force can be correctly delivered to the joint of the user. The assistive force may assist a movement of the joint of the user.

The main frame according to embodiments disclosed herein may closely contact the hip joint of the user and can stably support both sides of the hip joint. Therefore, the main frame can correctly deliver the first assistive force to the hip joint of the user, so that the user can stably walk, bend, or lift while wearing the exoskeleton.

The hip joint matching assembly can match the hip joint center axis of the user with the hip joint axis line of the position of the user where the hip joint is supported. When the user moves the hip joint while wearing the wearable assistive device or exoskeleton, the position of the hip joint matching assembly may match a position of the hip joint of the moving user. Therefore, even if a position of the hip joints of both sides of the user varies, the hip joint matching assembly may remain in a predetermined hip joint supporting position. Further, the hip joint matching assembly may stably provide an assistive force to the joint of the moving user. A part of the assistive force may not be lost while being delivered to the joint of the user.

The exoskeleton can closely contact the upper leg support to the thigh of the user. Accordingly, the upper leg support can correctly place each driving portion at the position of the joint of the user which requires an assistive force. Thus, the assistive force may not be lost while being delivered to the corresponding joints.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A wearable assistive device, comprising:

a waist support configured to support a waist of a user, the waist support having a first side and a second side;

a first frame coupled to the first side of the waist support, the first frame having a predetermined curvature so as to cover a side of a first hip joint of the user at a first hip joint supporting position;

a second frame coupled to the second side of the waist support, the second frame having a predetermined curvature so as to cover a side of a second hip joint of the user at a second hip joint supporting portion; and a hip matching assembly that connects the waist support to the first or second frame and interlocks with a movement of the first or second hip joint of the user to move the first or second frame, the hip matching assembly having:

a first rail portion that is provided at the waist support and moves the first frame at the first hip joint supporting position with a movement of the first hip joint, wherein the first rail portion comprises a first guide member including a first guide groove having a predetermined curvature and a first rail member provided at a lower end of the waist support and coupled with the first guide groove, wherein the first rail member is configured to move along the first guide groove in a curved path around a first rotation axis, and a second rail portion that connects the first rail portion to the first frame and moves the first frame at the first hip joint supporting position with a movement of the first hip joint, wherein the second rail portion comprises a second guide member provided at an inner side of a cover and including a second guide groove having a predetermined curvature.

2. The wearable assistive device of claim 1, wherein the second rail portion further comprises:

a second rail member provided at a rear of the first guide member and coupled to the second guide groove via a rail method such that the second rail member is configured to move along the second guide groove.

3. The wearable assistive device of claim 1, wherein the first rotation axis is a front-rear axis around which a leg pivots during adduction or abduction in a frontal plane of motion.

* * * * *